US008727512B2

(12) United States Patent
Mizuno

(10) Patent No.: US 8,727,512 B2
(45) Date of Patent: May 20, 2014

(54) INK CARTRIDGE

(75) Inventor: Naoki Mizuno, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 9 days.

(21) Appl. No.: 13/530,510

(22) Filed: Jun. 22, 2012

(65) Prior Publication Data

US 2012/0327162 A1 Dec. 27, 2012

(30) Foreign Application Priority Data

Jun. 24, 2011 (JP) ..... 2011-140605

(51) Int. Cl.
*B41J 2/175* (2006.01)

(52) U.S. Cl.
USPC ..... 347/85; 347/86; 347/84; 347/49

(58) Field of Classification Search
CPC ..... B41J 2/17576
USPC ..... 347/84–86; 137/558
See application file for complete search history.

(56) References Cited

U.S. PATENT DOCUMENTS

| | | | | |
|---|---|---|---|---|
| 5,574,489 | A * | 11/1996 | Cowger et al. | 347/86 |
| 6,886,928 | B2 * | 5/2005 | Sasaki et al. | 347/86 |
| 7,216,963 | B2 * | 5/2007 | Takagi | 347/86 |
| 7,497,545 | B2 * | 3/2009 | Shimizu | 347/22 |
| 7,682,004 | B2 * | 3/2010 | Hattori et al. | 347/84 |
| 2005/0151813 | A1 * | 7/2005 | Ikezaki | 347/86 |
| 2006/0001696 | A1 * | 1/2006 | Ha et al. | 347/32 |
| 2006/0028519 | A1 * | 2/2006 | Nakamura et al. | 347/87 |
| 2007/0040864 | A1 * | 2/2007 | Jung et al. | 347/22 |
| 2007/0109348 | A1 * | 5/2007 | Izawa et al. | 347/34 |
| 2007/0285482 | A1 * | 12/2007 | Hamano | 347/86 |
| 2008/0143781 | A1 * | 6/2008 | Inoue et al. | 347/34 |
| 2008/0316254 | A1 * | 12/2008 | Byun | 347/36 |
| 2009/0066749 | A1 * | 3/2009 | Young et al. | 347/36 |
| 2009/0073221 | A1 * | 3/2009 | Yoda et al. | 347/33 |
| 2009/0109254 | A1 * | 4/2009 | Satake et al. | 347/16 |

FOREIGN PATENT DOCUMENTS

JP 2011000751 A 1/2011

* cited by examiner

*Primary Examiner* — Matthew Luu
*Assistant Examiner* — Lily Kemathe
(74) *Attorney, Agent, or Firm* — Fox Rothschild LLP

(57) ABSTRACT

This disclosure discloses an ink cartridge comprises a housing, a detection plate configured to execute a display in accordance with an ink volume, and a support mechanism comprising a concave portion configured to rotatably support the detection plate, wherein: the detection plate comprises a shaft portion of a shape capable of engaging with a concave portion provided protruding from arm portions; at least one of the arm portions is capable of elastic deformation in which, upon receipt of an external force, changes the position of the shaft portion provided to the one of the arm portions to the extent that the concave portion and the shaft portion do not engage; and generates an elastic force that positions the shaft portion in a location that includes the rotation center of the arm portion when the external force is removed.

11 Claims, 23 Drawing Sheets

FIG. 16A
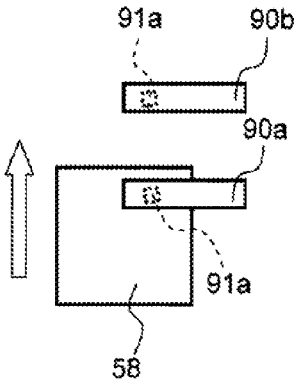
FIG. 16B
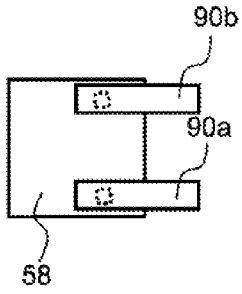
FIG. 16C
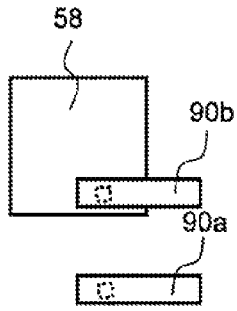
FIG. 16D
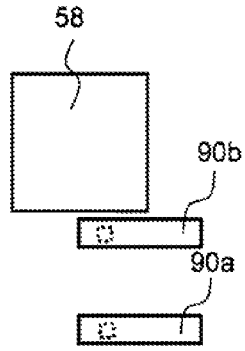
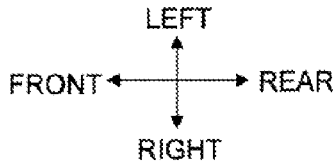
FIG. 16E
| | | | | |
|---|---|---|---|---|
| FIRST SENSOR | × | × | ○ | ○ |
| SECOND SENSOR | ○ | × | × | ○ |
| INK VOLUME | FULL | SUFFI-CIENT | CLOSE TO EMPTY | EMPTY |

INK CARTRIDGE

CROSS-REFERENCE TO RELATED APPLICATION

The present application claims priority from Japanese Patent Application No. 2011-140605, which was filed on Jun. 24, 2011, the disclosure of which is incorporated herein by reference in its entirety.

BACKGROUND OF THE INVENTION

1. Field of the Invention

The present invention relates to an ink cartridge that contains ink.

2. Description of the Related Art

Ink cartridges that are generally known comprise an ink bag that contains ink in its interior, a plug for extracting the contained ink from the ink bag, and a rectangular parallelepiped-shaped plastic case configured to house the ink bag.

The ink cartridge of the above-described prior art reference is provided with an opening on the housing. A needle that pierces into the rubber stopper of the plug and introduces the ink within the reservoir portion passes through the opening. While the plug can be visually checked from this opening, visually checking the volume of ink within the reservoir portion is difficult.

One possible approach is to make the moving member capable of rotation around the axis contact a lateral surface of the bag-shaped reservoir portion in the thickness direction, for example, and display the volume of ink within the reservoir portion by the movement of the moving member.

Nevertheless, in such a case, a structure that rotatably supports the axis of the moving member must be provided within the interior of the housing that is substantially box-like in shape. At this time, the structure must be assembled so that the moving member is rotatable with respect to the housing, which is originally a separate member. Further, after such assembly, the moving member must be made to not disengage from the housing. With normal axially supported structures, improving the assemble-ability of a moving member is difficult, resulting in the possibility of a decrease in the productivity of the ink cartridge.

SUMMARY OF THE INVENTION

It is therefore an object of the present invention to provide an ink cartridge capable of improving the assemble-ability of the moving member on the housing when the ink volume within the reservoir portion is to be displayed by the rotational position of the moving member, and thus improve productivity.

Means for Solving the Problems

In order to achieve the above-described object, according to the first invention, there is provided a n ink cartridge for storing ink, comprising: a reservoir portion configured to store ink; a housing configured to cover the reservoir portion; a moving member capable of executing a display in accordance with an ink volume within the reservoir portion based on a rotational position achieved by contacting the reservoir portion and rotating in accordance with a change in a contact position with the reservoir portion; and a support device provided to the housing and comprising at a predetermined interval in an axial direction of a plug of the reservoir portion two concave portions for rotatably supporting the moving member; wherein: the moving member has: two arm portions at least partially elastic, provided at a predetermined interval; and a convex portion of a shape engageable with the concave portion, provided protruding from each of two of the arm portions along a direction that intersects with an extending direction of the arm portion, disposed linearly at an interval; and at least one of the arm portions is capable of elastic deformation in which, upon receipt of an external force along a direction opposite a protruding direction of the convex portion, changes a position of the convex portion provided to the one of the arm portions to an extent that the concave portion and the convex portion do not engage, generates an elastic force near the predetermined interval when the external force is removed from the one of the arm portions, and positions the convex portion in a position that includes a rotation center of the arm portion when the concave portion and the convex portion engage.

According to the cartridge of the first aspect of the present invention, ink is stored in a reservoir portion disposed within the housing. Then, the moving member rotatably supported by a support device moves in accordance with the ink volume within the reservoir portion. Specifically, two convex portions, which respectively protrude in a direction orthogonal to an extending direction of two arm portions respectively provided at a predetermined interval to the moving member and are linearly disposed at an interval, engage with two concave portions disposed at a predetermined interval in the axial direction of the plug of the above-described reservoir portion of the support device provided to the housing. Then, the moving member is rotatably supported by the support device. With this arrangement, the moving member moves rotationally around the rotation center of the above-described arm portions on an axis that is in the same direction as the axial direction of the plug of the above-described reservoir portion, in accordance with the ink volume within the reservoir portion. As a result, the change in ink volume can be detected by the rotation of this moving member.

During the assembly of the ink cartridge according to the first aspect of the present invention, the above-described moving member is mounted to the support device fixed to the housing. The two arm portions of the moving member are partially elastic. With this arrangement, the distance between the two arm portions can be shortened or extended by utilizing external force. With the above-described mounting, external force is applied by hand in the direction opposite the protruding direction of the convex portion provided to at least one of the two arm portions, elastically deforming the one of the arm portions to the extent that the convex portion of the one of the arm portions does not engage with one concave portion of the support device. Then, in that state, the convex portion of the other arm portion engages with the other concave portion of the support device. Subsequently, the convex portion of the one of the arm portions is positioned to one concave portion of the support device, and the external force applied to the one of the arm portions is removed. Subsequently, the one of the arm portions returns to its original shape by the elastic force generated in the one arm portion. With this arrangement, each of the above-described two convex portions respectively engages with the concave portions and are rotatably supported around an axis that is in the same direction as the axial direction of the plug of the above-described reservoir portion.

With the two arm portions of the moving member thus used in a shortening or extending operation, the moving member can be easily mounted to the support device. As a result, the assemble-ability of the moving member is improved, making it possible to improve the productivity of the ink cartridge.

BRIEF DESCRIPTION OF THE DRAWINGS

FIG. 16A is a figure showing the ink volume detection method by the optical sensor.

FIG. 16B is a figure showing the ink volume detection method by the optical sensor.

FIG. 16C is a figure showing the ink volume detection method by the optical sensor.

FIG. 16D is a figure showing the ink volume detection method by the optical sensor.

FIG. 16E is a table showing the ink volume determination method based on the detection result of the optical sensor.

DETAILED DESCRIPTION OF PREFERRED EMBODIMENTS

The following describes an embodiment of the present invention with reference to accompanying drawings.

<Printer Overview>

Figure 1:
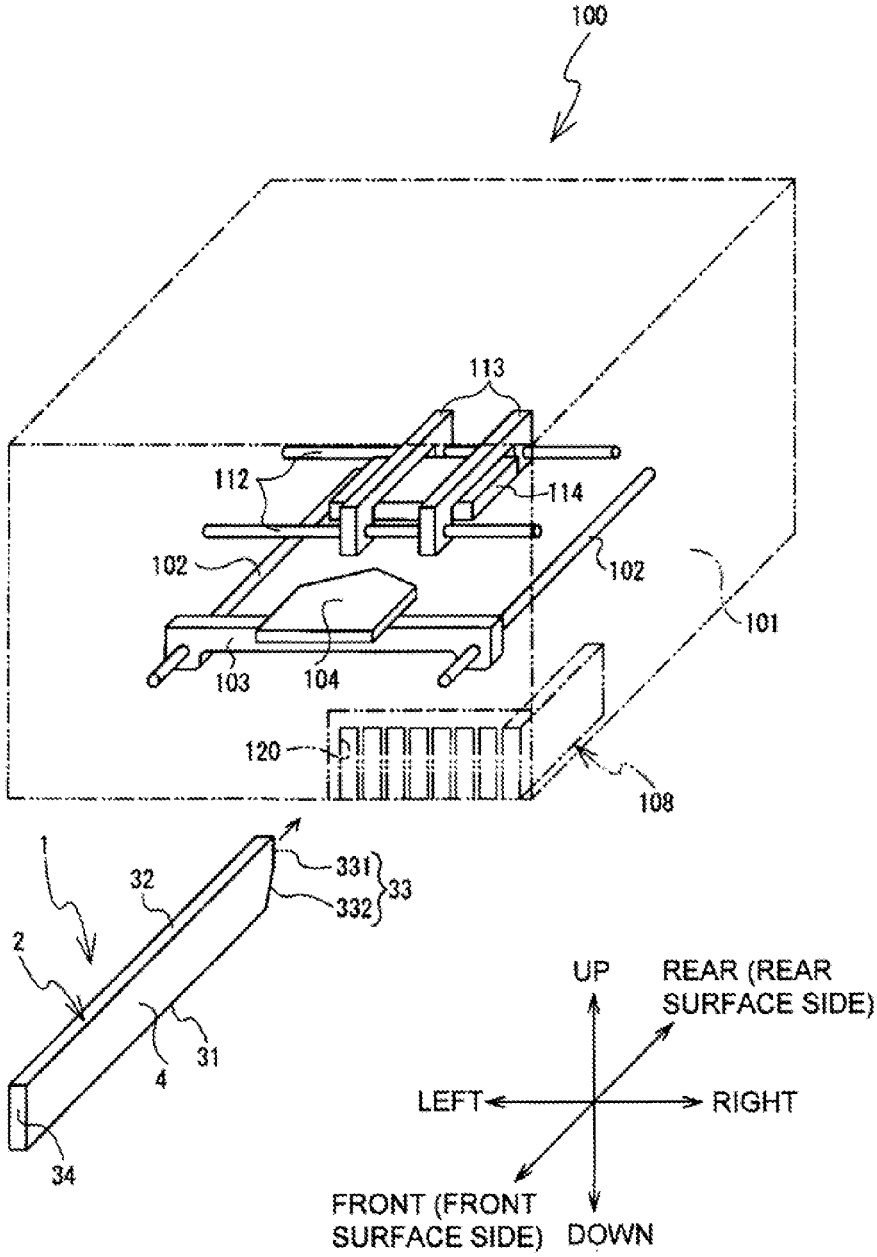
FIG. 1 is a perspective view showing the general configuration of the printer to which the ink cartridge of one embodiment of the present invention is applied, as viewed from the front.

The following describes the printer used in this embodiment, using FIG. 1. Note that, in the following description, the vertical (up/down) direction, front-rear direction, and horizontal (right/left) direction correspond to the directions of the arrows suitably shown in each figure. As shown in FIG. 1, a printer 100 used in this embodiment is an inkjet printer that uses ink supplied from an ink cartridge 1 and performs printing on fabric such as a T-shirt, for example, via a printhead 114.

This printer 100 comprises a platen 104, the above-described printhead 114, a carriage 113, a pair of guide bars 112, and a carriage drive mechanism within a box-shaped housing 101. The platen 104 sets and horizontally supports the fabric (not shown). The printhead 114 discharges ink supplied from the ink cartridge 1 onto the fabric supported by the platen 104, printing letters, images, etc., on the fabric. The carriage 113 holds the printhead 114 and moves the printhead 114 back and forth to the left side and the right side in FIG. 1. The guide bars 112 guide the carriage 113 horizontally. The carriage drive mechanism includes a carriage drive motor (not shown) that drives the carriage 113 along the guide bars 112.

Eight cartridge mounting portions 108 that extend in the front-rear direction are provided to a lower location near the front right of the housing 101. A cartridge insertion port 120 of each of the cartridge mounting portions 108 opens on the front of the housing 101. Note that FIG. 1 shows only one of the cartridge mounting portions 108 and one of the cartridge insertion ports 120 to avoid complexities in illustration. The length of the cartridge mounting portion 108 is, for example, about one-third of the length of the ink cartridge 1. The ink cartridge 1 is mounted to the cartridge mounting portion 108, and thus inserted inside the printer 100 in a state that enables ink supply. Then, the ink is supplied from the ink cartridge 1 to the printhead 114 via a tube within the printer 100. The eight ink cartridges 1 comprise, for example, four white ink cartridges, one cyan ink cartridge, one magenta ink cartridge, one yellow ink cartridge, and one black ink cartridge.

<Ink Cartridge>

Figure 2:
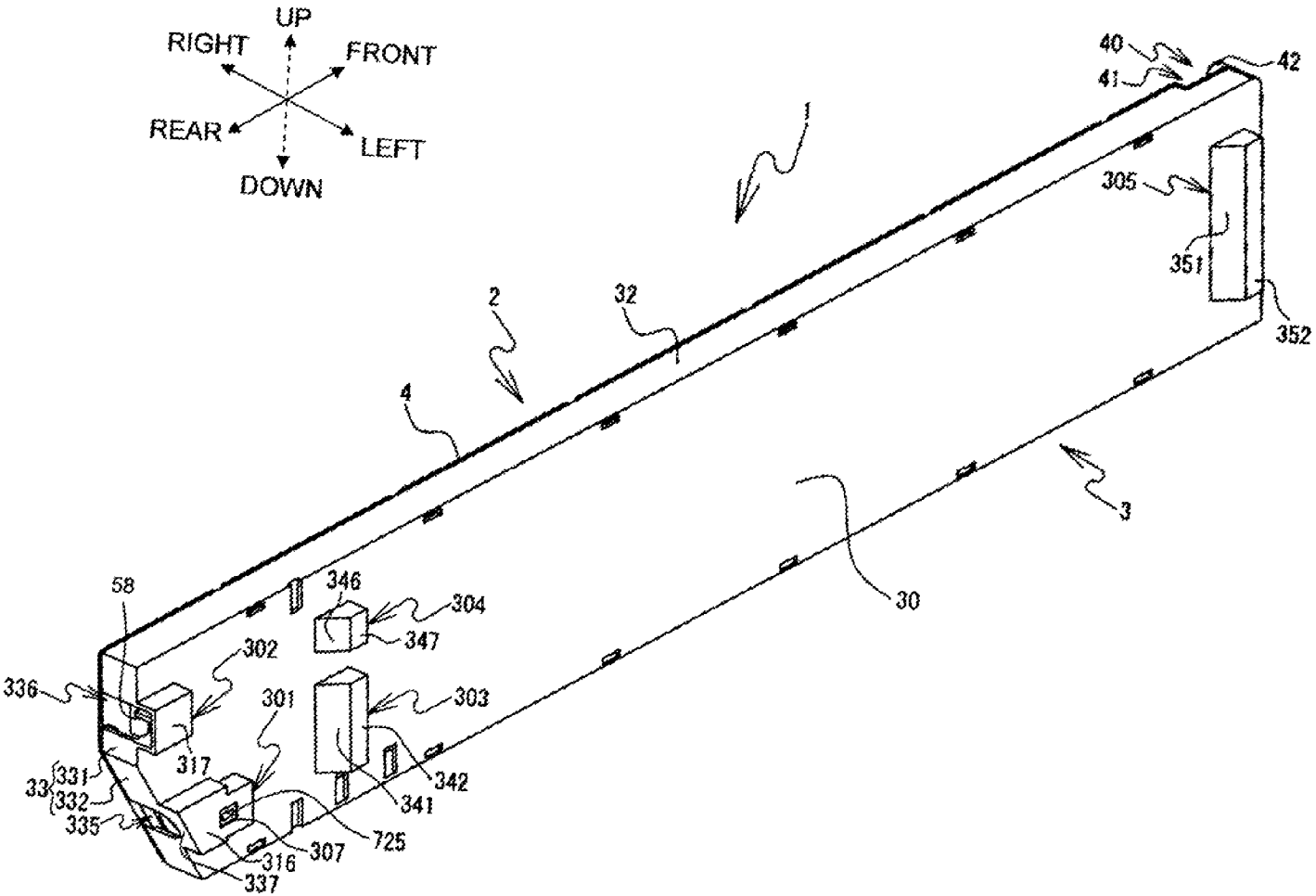
FIG. 2 is a perspective view showing the outer appearance of the ink cartridge of one embodiment of the present invention, as viewed from the rear.
Figure 3:
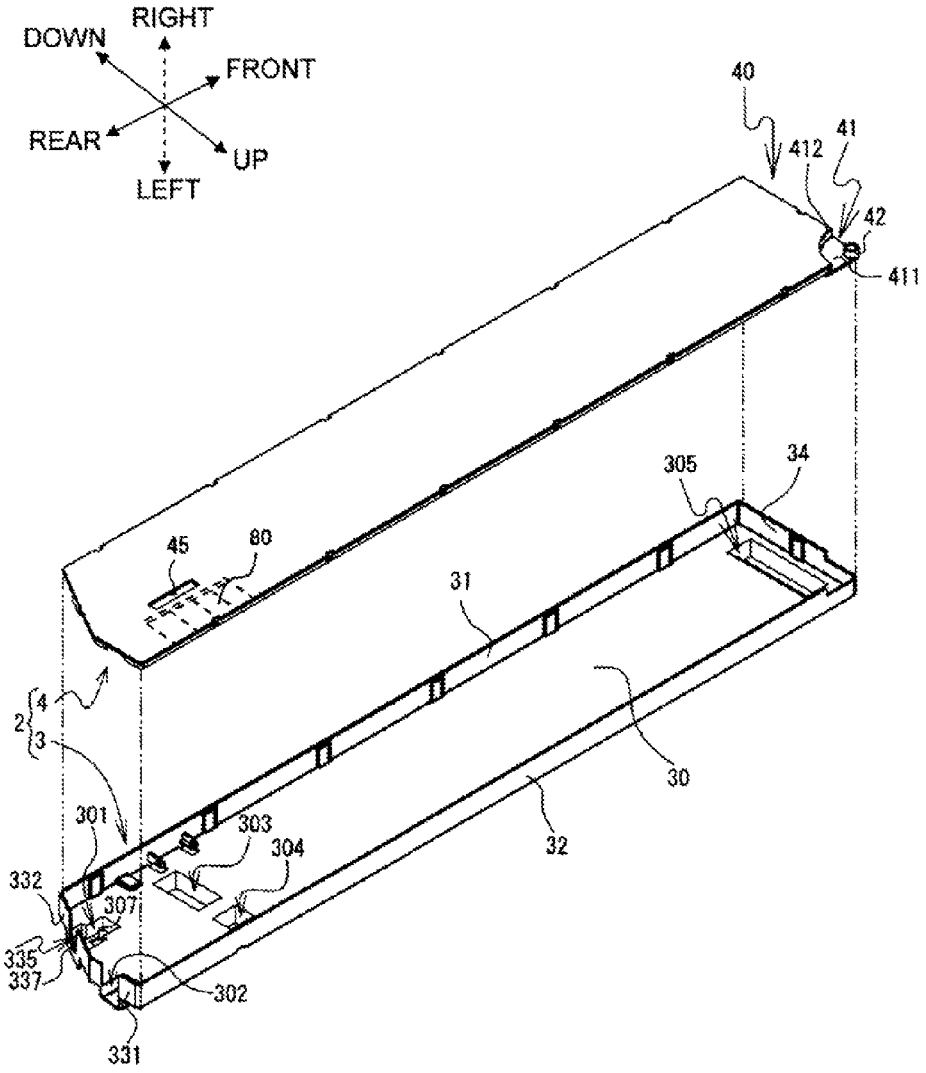
FIG. 3 is an exploded perspective view of the housing of the ink cartridge.
Figure 4:
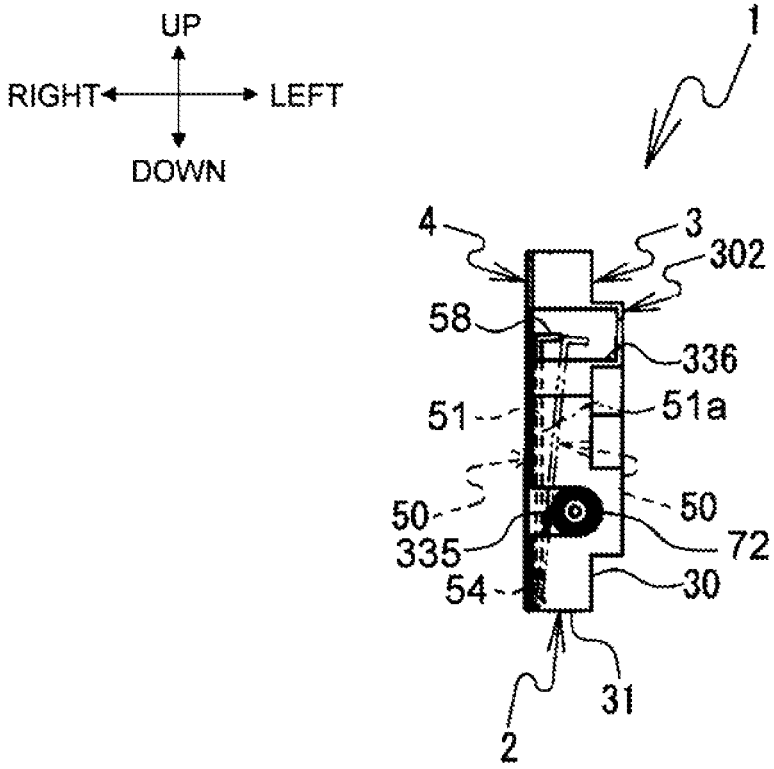
FIG. 4 is a rear view of the ink cartridge.

The following describes the overall configuration of the ink cartridge 1, using FIG. 2 to FIG. 6. As shown in FIG. 2 to FIG. 4, in this embodiment, the ink cartridge 1 comprises a housing 2, an ink pack 7 (see FIG. 7 described later) housed within this housing 2, and a detection plate 50 configured to detect the ink volume of the above-described ink pack 7 provided within the housing 2. The housing 2 comprises a longwise direction, that is, a front-rear direction; a shortwise direction, that is, a vertical direction, orthogonal to the longwise direction; and a thickness direction, that is, a horizontal direction or width direction, that is orthogonal to the longwise direction and shortwise direction. Then, the housing 2 is provided with a thin and slender substantially rectangular parallelepiped shape, narrow in width and long in the front-rear direction. The ink cartridge 1, according to this example, is used with the longwise direction and thickness direction of the housing 2 substantially horizontal, and the shortwise direction substantially vertical (see FIG. 1). The substantially rectangular parallelepiped shape described here is a shape in which the general rough outer appearance is nearly rectangular parallelepiped. That is, the substantially rectangular parallelepiped shape may have a surface locally sloped with respect to the above-described longwise direction, shortwise direction, or thickness direction, or may have an odd-shaped section, such as a stepped-shaped section or the like. According to this embodiment, the housing 2, as described later, is substantially rectangular parallelepiped in shape, with a sloped lower rear wall portion 332 that connects with the left wall portion 30.

The above-described housing 2, as shown in FIG. 3, comprises a housing main body 3 and a cover 4. The housing main body 3 comprises a substantially thin, long, and narrow rectangular parallelepiped shape that fully opens on the right side, that is, on the other lateral surface on the other side in the thickness direction. The cover 4 comprises a long and narrow plate shape for covering the above-described opening. The housing main body 3 and the cover 4 are provided with an engaging hook and an engaging hole, or with an engaging pin and an engaging hole. Then, the housing is assembled by inserting these together and connecting the housing main body 3 and the cover 4 or by welding the housing main body 3 and the cover 4.

The housing main body 3 comprises a left wall portion 30, a bottom wall portion 31, an upper wall portion 32, a rear wall 33, and a front wall portion 34. The rear wall 33, as shown in FIG. 2, comprises a vertical upper rear wall portion 331 that connects with the upper wall portion 32 and the left wall portion 30, and a sloped lower rear wall portion 332 that connects with the left wall portion 30 and the bottom wall portion 31 of the housing main body 3. The bottom wall portion 31 is somewhat shorter than the upper wall portion 32, and the rear end of the bottom wall portion 31 is positioned so that it recedes toward the front side of the housing main body 3. The lower rear wall portion 332 slopes inward from the upper rear wall portion 331 toward the bottom wall portion 31. An ink volume detection opening 336 of the ink pack 7 and a plug opening 335 are respectively provided to the upper rear wall portion 331 and the lower rear wall portion 332. As shown in FIG. 4, a display portion 58 provided to the upper end of the above-described detection plate 50 faces the ink volume detection opening 336. A plug 72 provided on the rear end of the ink pack 7 faces the plug opening 335.

As shown in FIG. 3, five protruding portions, including a first rear protruding portion 301, a second rear protruding portion 302, a first intermediate protruding portion 303, a second intermediate protruding portion 304, and a front protruding portion 305, are provided by indenting the inner surface of the left wall portion 30 toward the outer surface side.

The first rear protruding portion 301 comprises the convex-shaped planar portion 316 that is parallel with the left wall portion 30. Further, the first rear protruding portion 301 is formed as a protruding portion that joins with the lower rear wall portion 332. The plug opening 335 of the above-described lower rear wall portion 332 is formed into a lateral U-shape on the lower rear wall portion 332. At this time, the plug opening 335 is formed so that the U-shaped end portion in the protruding direction extends across to the joining portion of the lower rear wall portion 332 of the first rear protruding portion 301. Note that the vicinity of the end portion of plug opening 335 on the left wall 30 side serves as a joining wall portion 337. The first rear protruding portion 301 comprises a rectangular engaging hole 307.

The second rear protruding portion 302 comprises a convex-shaped planar portion 317 that is parallel with the left wall portion 30. Further, the second rear protruding portion 302 is formed as a protruding portion that joins with the upper rear wall portion 331. The ink volume detection opening 336 of the above-described upper rear wall portion 331 forms a lateral rectangular shape from the upper rear wall portion 331 to the second protruding portion 302. The first intermediate protruding portion 303 and the second intermediate protruding portion 304 are provided in locations near the rear portion of the left wall portion 30 and are separated vertically. The front protruding portion 305 is provided in a location near the front portion of the left wall portion 30. These first and second intermediate protruding portions 303 and 304 and front protruding portion 305 each comprise convex-shaped planar portions 342, 347, and 352 that are parallel with the left wall portion 30. Gentle sloped portions 341, 346, and 351 that slope toward the rear direction are formed on the rear sides of these convex-shaped planar portions 342, 347, and 352.

The convex-shaped planar portions 316, 317, 342, 347, and 352 of these protruding portions 301, 302, 303, 304, and 305 have the same height. With this arrangement, when a worker performs a task such as installing the cover 4 or placing the ink pack 7 within the housing main body 3, the worker performs the operation with the housing main body 3 laid on a horizontal plane, such as a work table, as shown in FIG. 3. Then, the worker can stably support the housing main body 3 on the plane using the protruding portions 301 to 305 and effectively perform the task.

Note that the first and second intermediate wall portions 303 and 304 comprise an identification function that permits color identification by the user. That is, when the second intermediate wall portion 304 is short, the first intermediate wall portion 303 is long, and the condition described later is satisfied, the ink color of the ink pack 7 housed within the housing 2 is white. The condition is that the second intermediate wall portion 304 does not intersect with the strip region in the front-rear direction of the housing 2, which has a width that between the boundary location of the upper and lower rear walls 331 and 332 and the lower end location of the second rear protruding portion 302. Further, if the second intermediate wall portion 304 is long, the first intermediate wall portion 303 is short, and the second intermediate wall portion 304 intersects with the above-described strip region, the ink color of the ink pack 7 housed in the housing 2 is yellow, magenta, and cyan.

Figure 5:
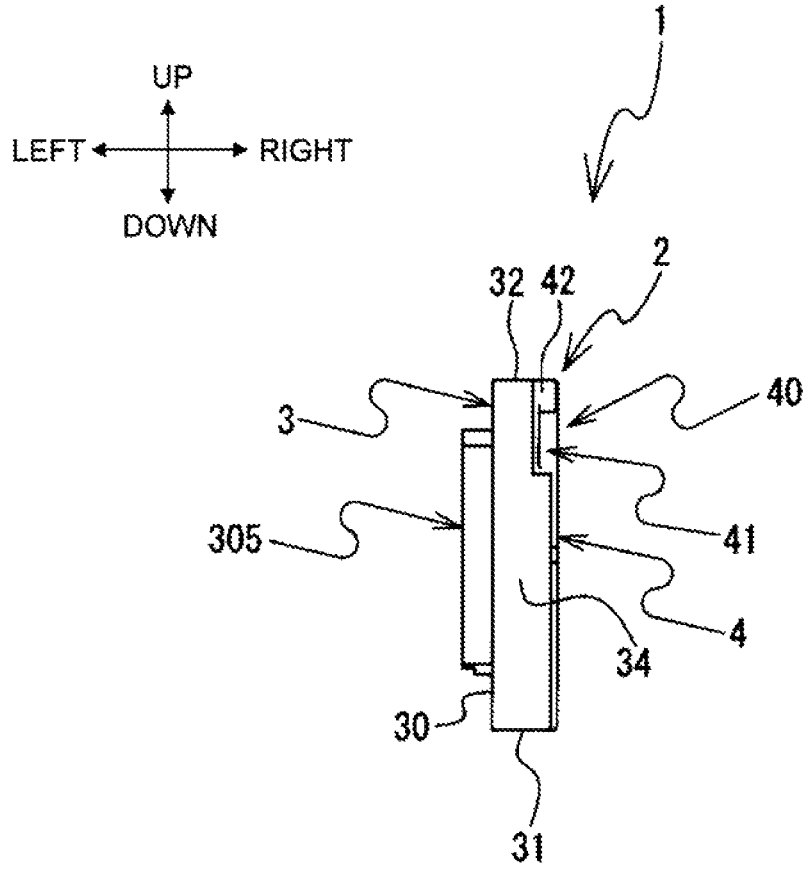
FIG. 5 is a front view of the ink cartridge.

A gripping portion 40 of the housing 2 is provided to the upper front corner portion of the cover 4, as shown in FIG. 3. The gripping portion 40 comprises a fan-shaped recessed portion 41 and a protruding portion 42. The recessed portion 41 comprises a fan-shaped surface portion 411 of an included angle of 90° that indents the upper front corner portion of the cover 4 from the outer surface side toward the inner surface side, and a peripheral wall 412. The protruding portion 42 protrudes in the direction opposite the recessed direction, near the pivot of the fan of the recessed portion 41, and comprises a length that is shorter than the depth of the recessed portion 41. The upper front corner portion of the housing main body 3, as shown in FIG. 3 and FIG. 5, cuts out the upper wall portion 32 and the front wall portion 34 to ensure reception of both sides of the fan shape on the bottom surface of the recessed portion 41, thus receiving the recessed portion 41. With such the gripping portion 40 provided to the housing 2, the worker can securely grip and easily remove the cartridge 1. For example, even in a case where a plurality of cartridges 1 is mounted with slight gaps therebetween to the cartridge mounting portion 108 of the printer 100, for example, the worker can put one of his or her fingers used to pinch both sides of the housing 2 on the gripping portion 40.

Figure 6:
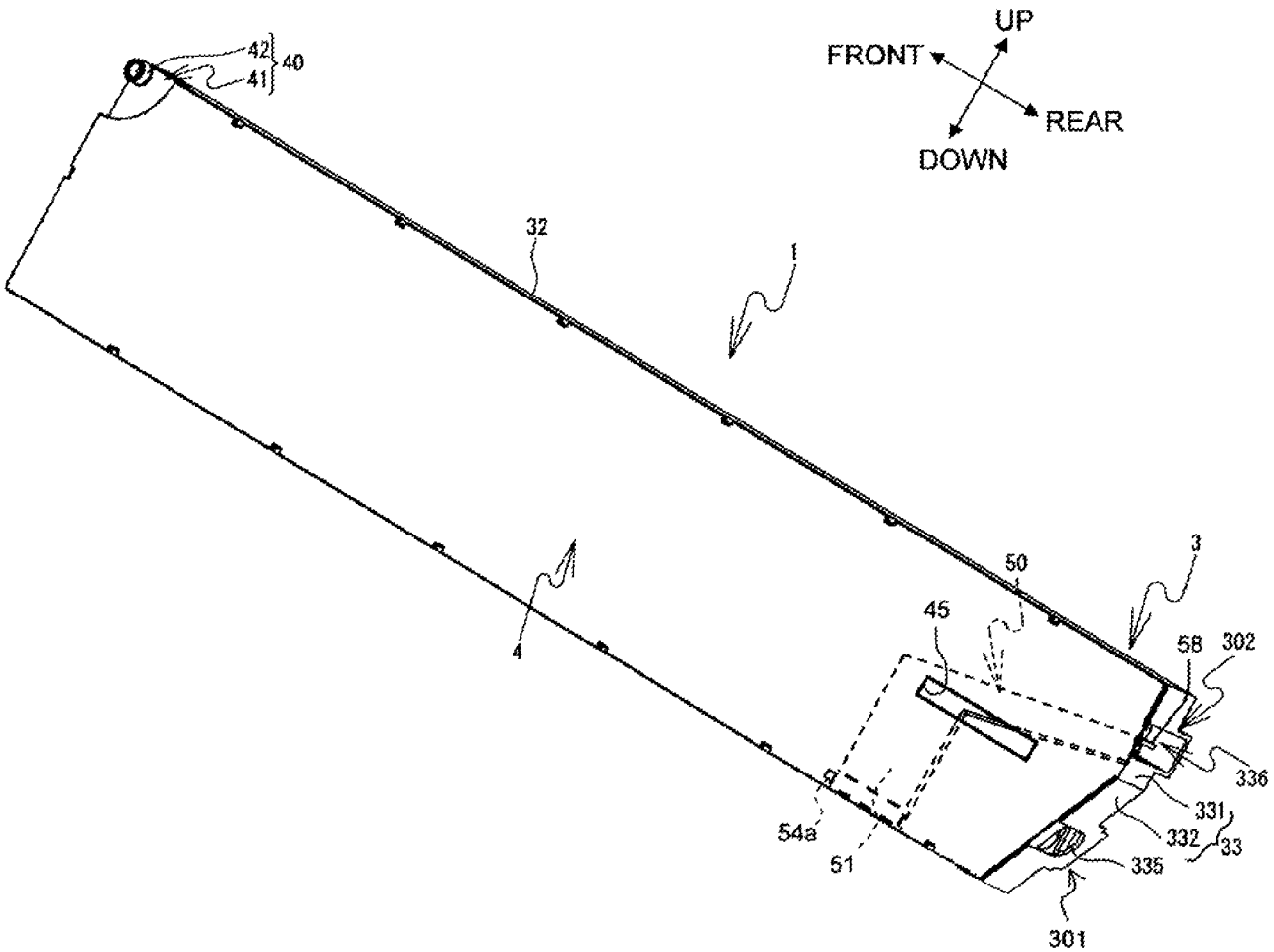
FIG. 6 is a perspective view of the ink cartridge, as viewed from the rear.

Further, an observation hole 45 that is long in the front-rear direction and passes through the cover 4 is provided at a location near the rear portion of the cover 4. As shown in FIG. 6, a part of the detection plate 50 and the ink pack 7 within the housing 2 is visible through the observation hole 45.

<Ink Pack>

Figure 7:
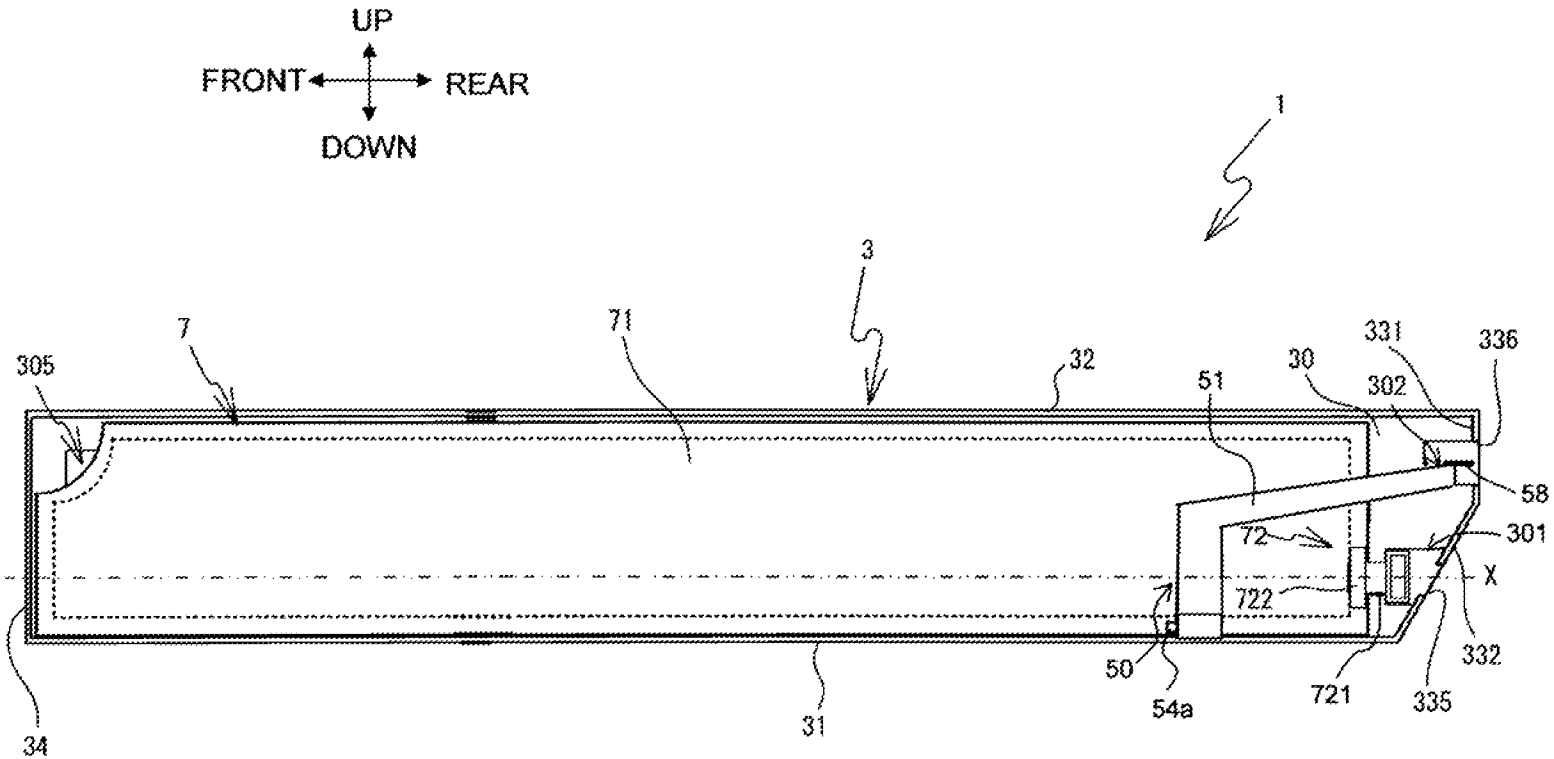
FIG. 7 is a side view showing the housing main body where the ink pack and detection plate are provided.

Next, the structure of the ink pack 7 and the surrounding area thereof will be described using FIG. 7 to FIG. 9. As shown in FIG. 7, the ink pack 7 comprises a long, narrow, bag-shaped reservoir portion 71 that stores ink, and the above-described plug 72 installed to the rear end portion of this reservoir portion 71. The reservoir portion 71 is formed by overlapping two long and narrow rectangular-shaped flexible sheets made of a transparent resin and heat-sealing a surrounding portion 716 (see FIG. 9) of the four sides thereof. The flexible sheets are configured by cutting out a front corner portion into a fan shape in accordance with the gripping portion 40 of the cover 4. The ink pack 7 is disposed within the housing 2 with the left side, that is, one side in the thickness direction, of the reservoir portion 71 contacting the left wall portion 30 of the housing main body 3.

The plug 72 comprises a resin, cylindrical main body portion 721 and a joining portion 722 that has a square cylindrical shape with a long and narrow width in the vertical direction. The cylindrical main body portion 721 is formed in a rectangular block shape having a rear side that is relatively large. The joining portion 722 is integrally provided with the front portion of the main body portion 721.

Figure 8:
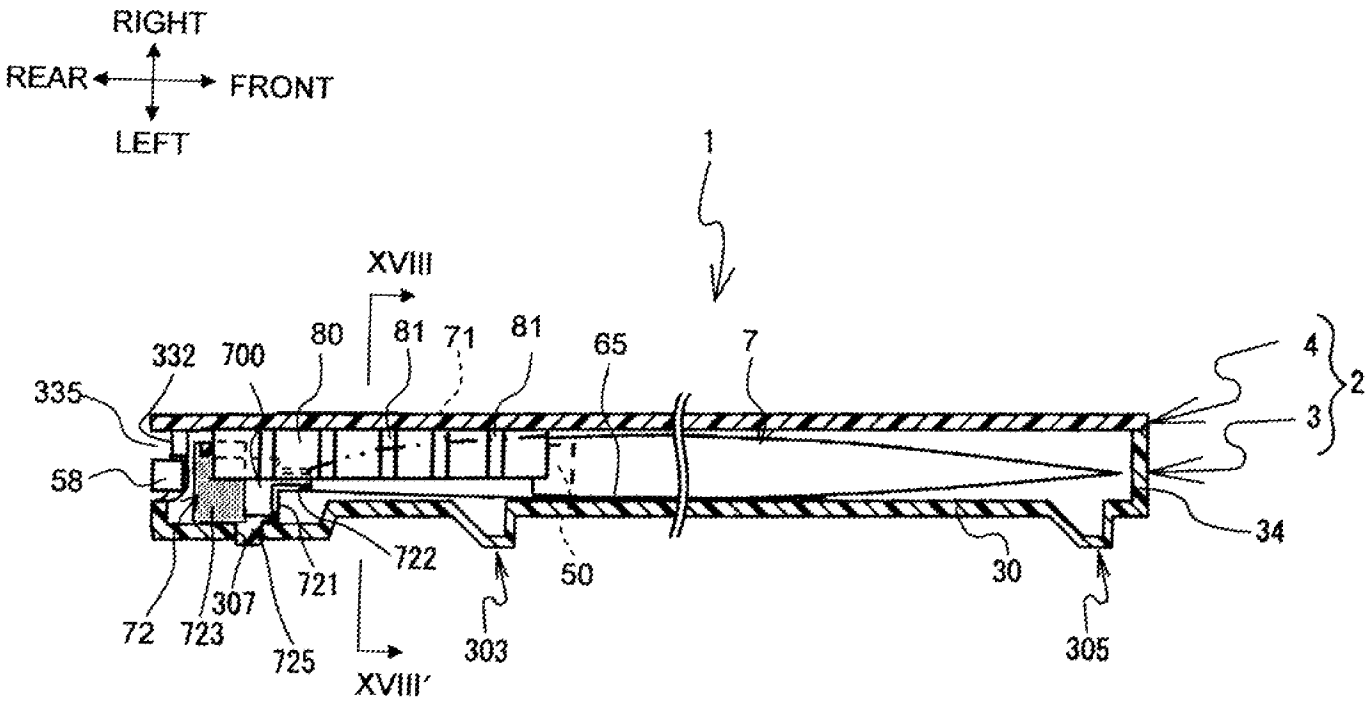
FIG. 8 is a horizontal sectional view of the ink cartridge.

The main body portion 721, as shown in FIG. 8, comprises a hollow portion 700 on the inside, which links with a small hole through which the joining portion 722 is inserted. A rubber stopper 723 that blocks the rear end portion of the hollow portion 700 is inserted into the rear portion of the main body portion 721. The joining portion 722 of the plug 72 is inserted between the two sheets that make up the reservoir portion 71 on the rear end portion of the reservoir portion 71, and heat-sealed per sheet. With this arrangement, the plug 72 is secured to the rear end portion of the reservoir portion 71 so that it is liquid tight, with an axial direction X thereof (see FIG. 7) aligned in the longwise direction, that is, the front-rear direction, of the reservoir portion 71. A prismatic joining protruding portion 725 is provided on the outer peripheral surface of the rectangular block-shaped section of the main body portion 721. The joining protruding portion 725 positions the plug 72 with respect to the housing 2, specifically with respect to the side wall portion 30 of the housing main body 3.

Note that a collapse prevention rib 80 that prevents collapse of the upper portion of the reservoir portion 71 is provided to the cover 4, extending above the detection plate 50. Furthermore, a reinforcement rib 81 that reinforces the collapse prevention rib 80 is provided to the cover 4. The collapse prevention rib 80 and the reinforcement rib 81 will be described later.

Figure 9:
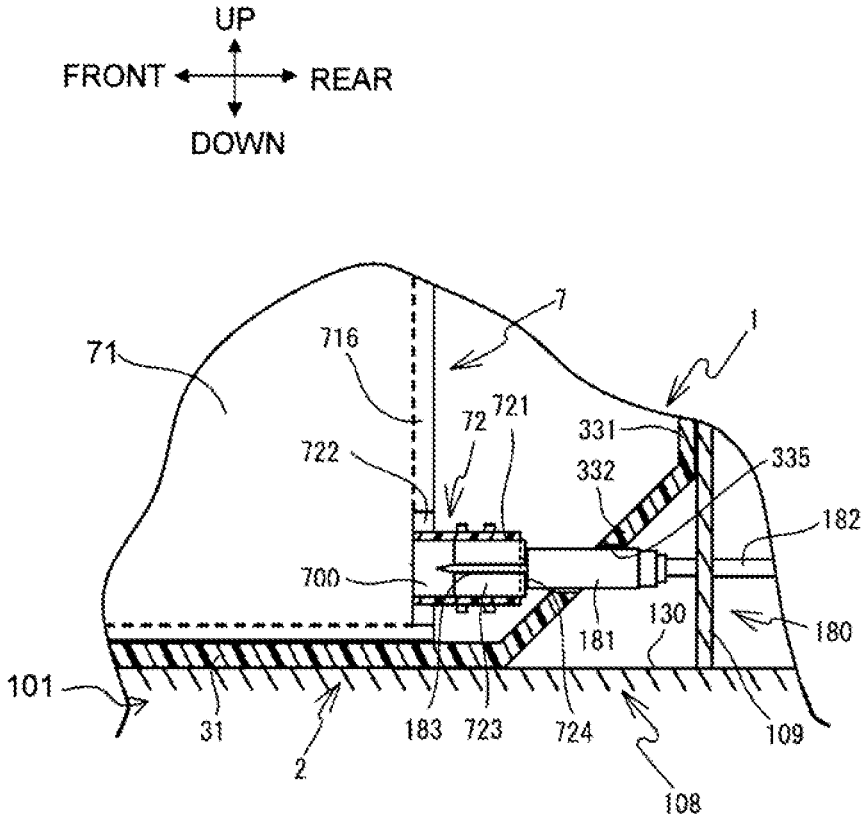
FIG. 9 is a longitudinal sectional view of the main parts, showing the rear of the cartridge mounting portion of the housing of the printer.

On the other hand, as shown in FIG. 9, a horizontal mounting table 130 and an abutment plate 109 are provided to the cartridge mounting portion 108 of the housing 101 of the printer 100. The mounting table 130 mounts the ink cartridge 1. The abutment plate 109 stands substantially vertically upward from the above-described mounting table 130 on the rear portion of the cartridge mounting portion 108. Further, a connecting portion 180 is provided to the rear end portion of the cartridge mounting portion 108. The connecting portion 180 is securely provided within the cartridge mounting portion 108 so that it is concentric with the plug 72, in front of the abutment plate 109. The connecting portion 180 comprises a cylindrical securing portion 181 to which an ink tube 182 is connected on the rear end, and a hollow lead needle 183 comprising a hole on the end side that protrudes frontward from the front center of the securing portion 181.

The ink cartridge 1 is inserted into the cartridge mounting portion 108, rear portion first, and set into the cartridge mounting portion 108 with the rear portion of the housing 2 in contact with the abutment plate 109. A part of the securing portion 181 of the connecting portion 180 enters the housing 2 from the plug opening 335 as the cartridge 1 is inserted. Then, the lead needle 183 of the front portion of the securing portion 181 is further inserted through the center of the rubber stopper 723 from an end portion 724 of the rubber stopper 723 of the main body portion 721 of the plug 72. As a result, the end portion of the lead needle 183 is positioned within the hollow portion 700 of the main body portion 721. With this arrangement, the reservoir portion 71 of the ink pack 7 and the ink tube 182 on the printer 100 side are connected via the plug 72 and the connecting portion 108. As a result, the ink within the reservoir portion 71 is discharged into the ink tube 182 through the hollow portion 700 of the plug 72, the lead needle 183, and the securing portion 181 of the connecting portion 108 and supplied from the ink tube 182 to the printhead 114.

<Detection Plate>

Figure 10:
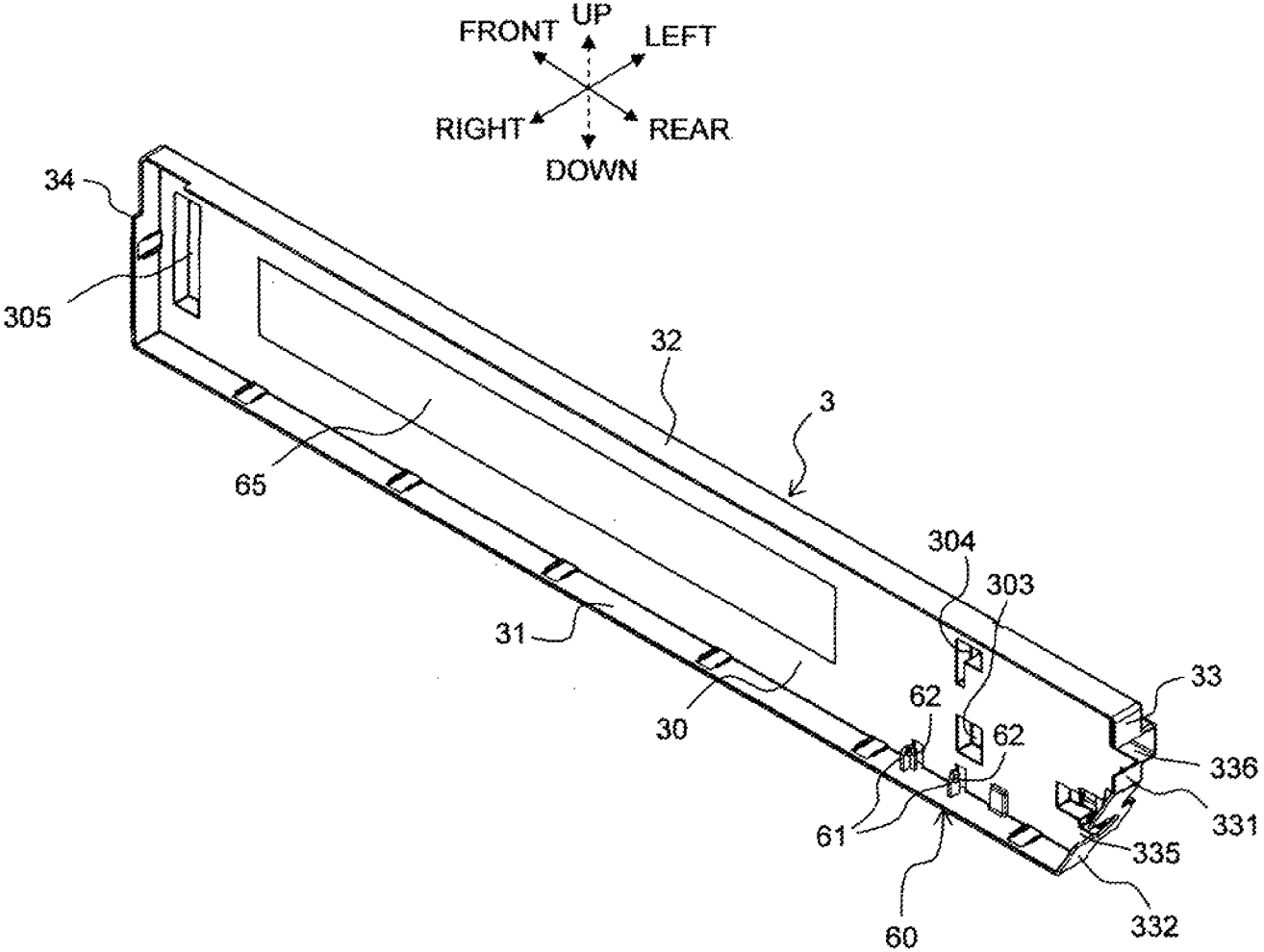
FIG. 10 is a perspective view of the ink cartridge, as viewed from the rear of the housing main body.
Figure 11:
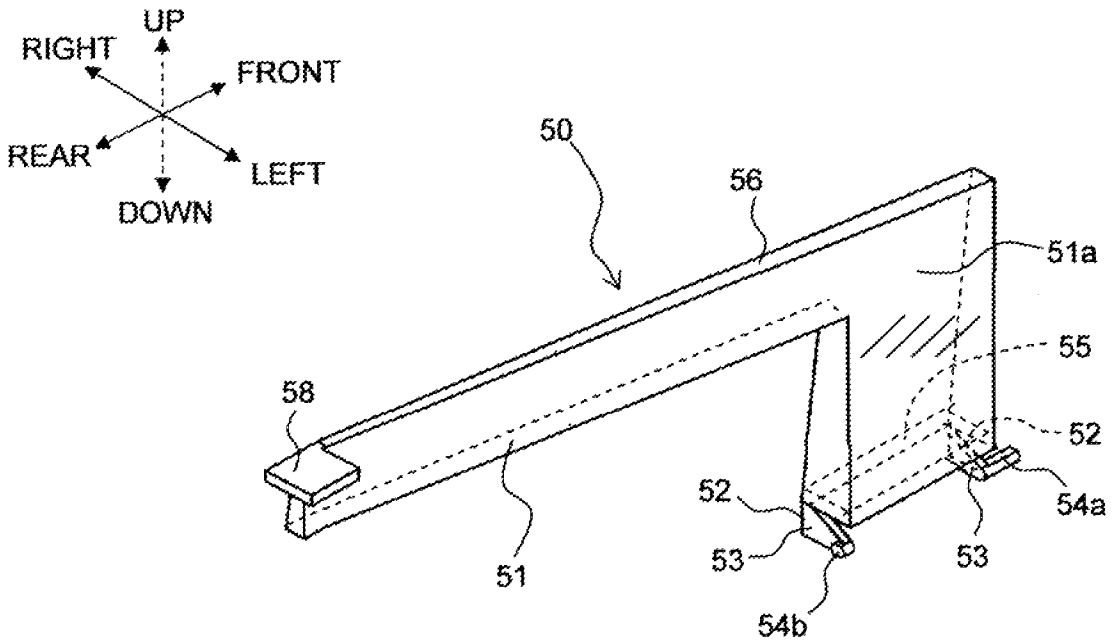
FIG. 11 is a perspective view showing the detection plate installed in the housing main body.
Figure 12A:
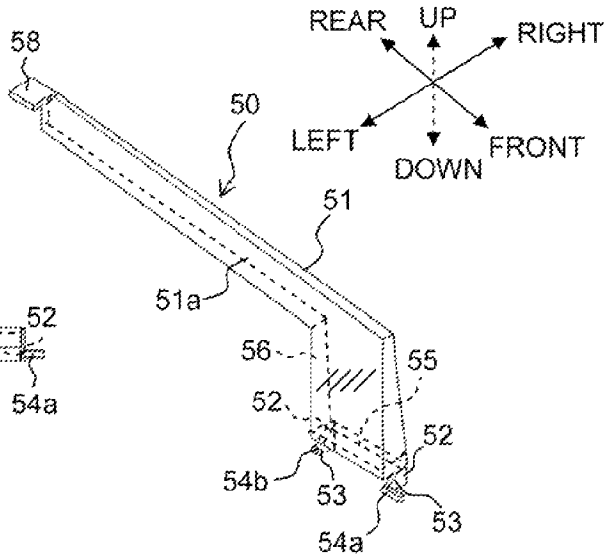
FIG. 12A is a perspective view showing the detection plate installed in the housing main body.
Figure 12B:
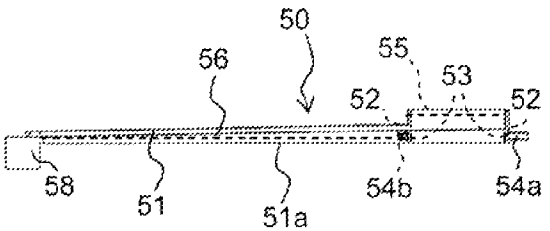
FIG. 12B is a top view showing the detection plate installed in the housing main body.
Figure 12C:
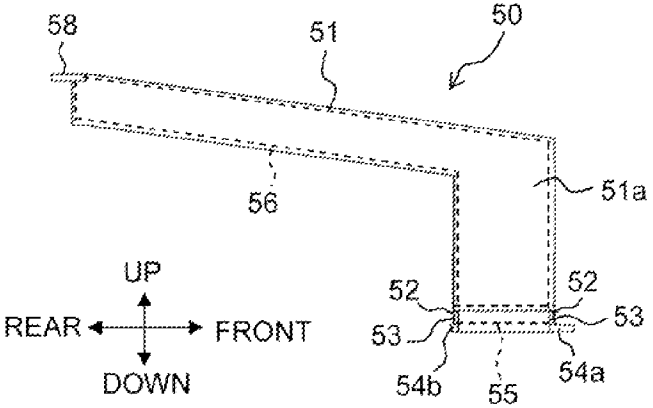
FIG. 12C is a side view showing the detection plate installed in the housing main body.

Next, the detailed structure of the detection plate 50, which is one special characteristic of this embodiment, and its installation state will be described using FIG. 10 to FIG. 14. As shown in FIG. 10, an adhesive portion 65, that is, for example, double-sided tape, is provided in a strip shape in the longwise direction to the vertical center of the left wall portion 30 of the housing main body 3, on the inner surface. The adhesive portion 65 contacts and secures the left side of the reservoir portion 71 of the ink pack 7 housed within the housing 2. The disposed area of the adhesive portion 65 is established on the inner surface area of the left wall portion 30, between the front protruding portion 305, the first intermediate protruding portion 303, and the second intermediate protruding portion 304. The disposed area of the adhesive portion 65 is outside the range of the disposed area of the detection plate 50 provided within the housing 2, specifically, further toward the front than the disposed area of the detection plate 50. A support mechanism 60 is provided near the left side of the housing 2, at the inner surface location of the bottom wall portion 31 further rearward than the provided area of the adhesive portion 65 of the housing main body 3. The support mechanism 60 rotatably supports the detection plate 50. The support mechanism 60 comprises two front and rear mounting plates 61 and 61 provided at an in interval in the longwise direction, that is, the front-rear direction, of the housing 2. Concave portions 62 and 62 which respectively engage with shaft portion 54*a* and 54*b*, that is, convex portions, provided to the detection plate 50 are provided to each of the mounting plates 61. In other words, the concave portions 62 and 62 are disposed at a predetermined interval in the axial direction of the above-described plug 72. While established as a through-hole according to this example, the concave portion 62 may be a blind hole that opens in a direction opposite the protruding direction of the shaft portions 54*a* and 54*b* of the detection plate 50 and, if so, is given a depth deeper than at least the shaft portions 54*a* and 54*b*.

The detection plate 50, as shown in FIG. 11 and FIGS. 12A to 12C, is made of a substantially inverted L-shaped frame formed by a flexible material, which is resin according to this example. The detection plate 50 comprises an abutment plate 51 that bends into an inverted L-shape, two front and rear arm portions 52 and 52, the shaft portions 54*a* and 54*b*, the planar display portion 58, and a connecting plate 55.

A left surface 51*a* of the abutment portion 51 comes in contact with the right side of the ink pack 7. The two front and rear arm portions 52 and 52 are provided to the front side, specifically, one bent side, that is, an end portion of the lower side, that is, a lower end portion, of the abutment portion 51, and disposed at a predetermined interval in the longwise direction, that is, the front-rear direction, of the housing 2. The above-described shaft portions 54*a* and 54*b* are provided to support plates 53 of the respective arm portions 52 so that they protrude outward in the extended direction, that is, a direction that intersects the horizontal direction, that is, the front-rear direction, of the arm portions 52, and are linearly disposed at an interval. The display portion 58 is provided to the other bent side, that is, the end portion of the upper side, that is, the upper end portion, which is the rear side of the abutment plate 51. The connecting plate 55 connects the two support plates 53, firmly supporting the support plates 53.

An edge frame 56 is provided to the surrounding area, excluding one bent side, that is, the end portion on the lower side, of the abutment plate 51. The edge frame 56 protrudes to the left of the abutment plate 51, and gradually narrows along the other bent side, that is, the upper side, of the abutment plate 51. The abutment plate 51 is reinforced by the edge frame 56.

The support plate 53 is formed on the arm portion 52 in a substantially triangular shape or substantially trapezoidal shape, extending from one side, that is, the end portion area on the left side, to the other side, that is, the area on the right side, to provide higher elasticity to the arm portion 52. The arm portion 52 connects with the abutment plate 51 on the other side, that is, the area on the right side, of the support plate 53. The shaft portion 54 is provided to one side, that is, the end portion area on the left side, of the support plate 53. Then, to ensure strength during the elastic deformation of the arm portion 52, the arm portion 52 is provided so that it juts out on the other side, that is, the right side, further than the other side, that is, the right end portion, of the abutment plate 51.

Figure 13:
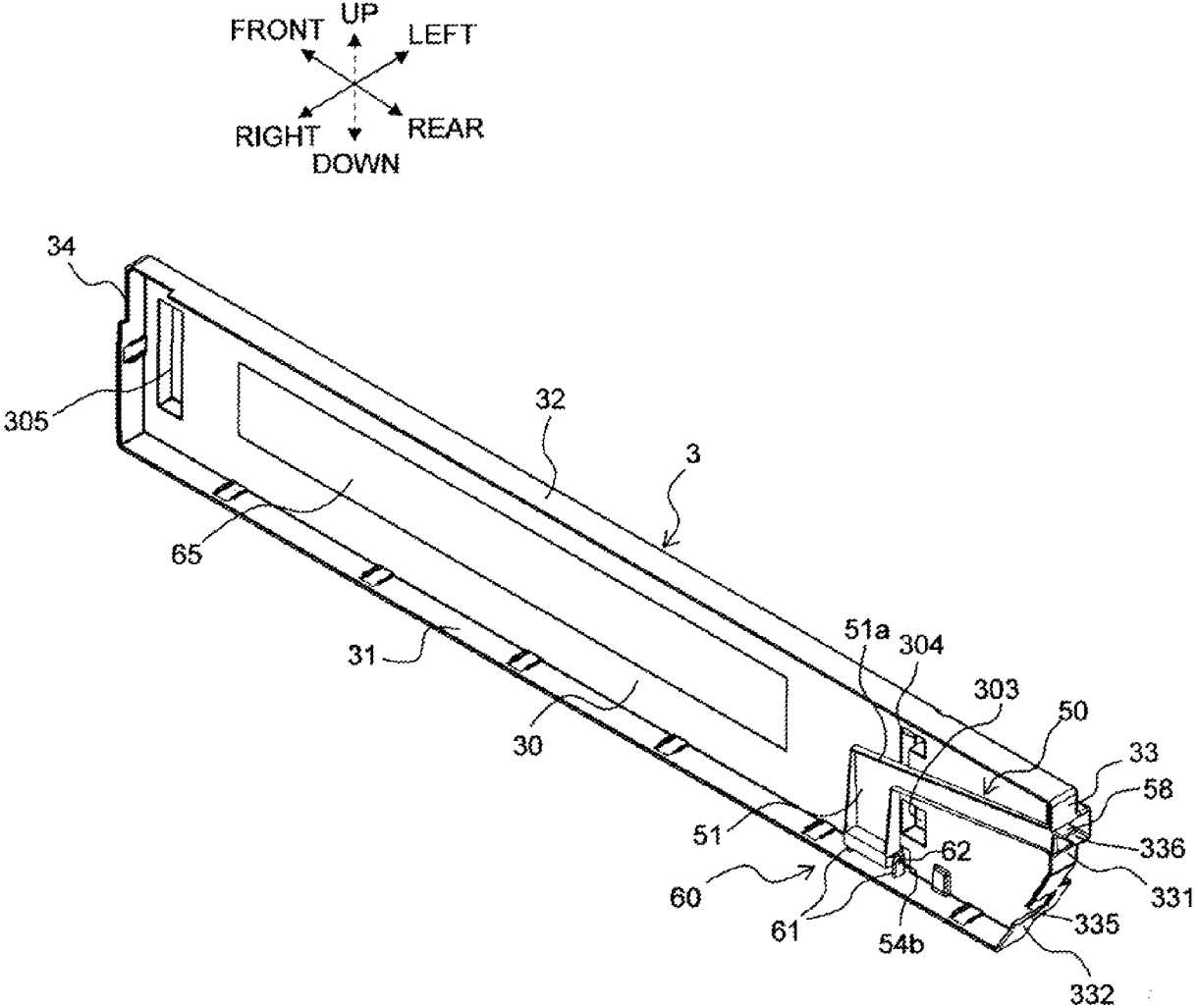
FIG. 13 is a perspective view showing the housing main body in which the detection plate is installed, as viewed from the upper left on the rear side.
Figure 14:
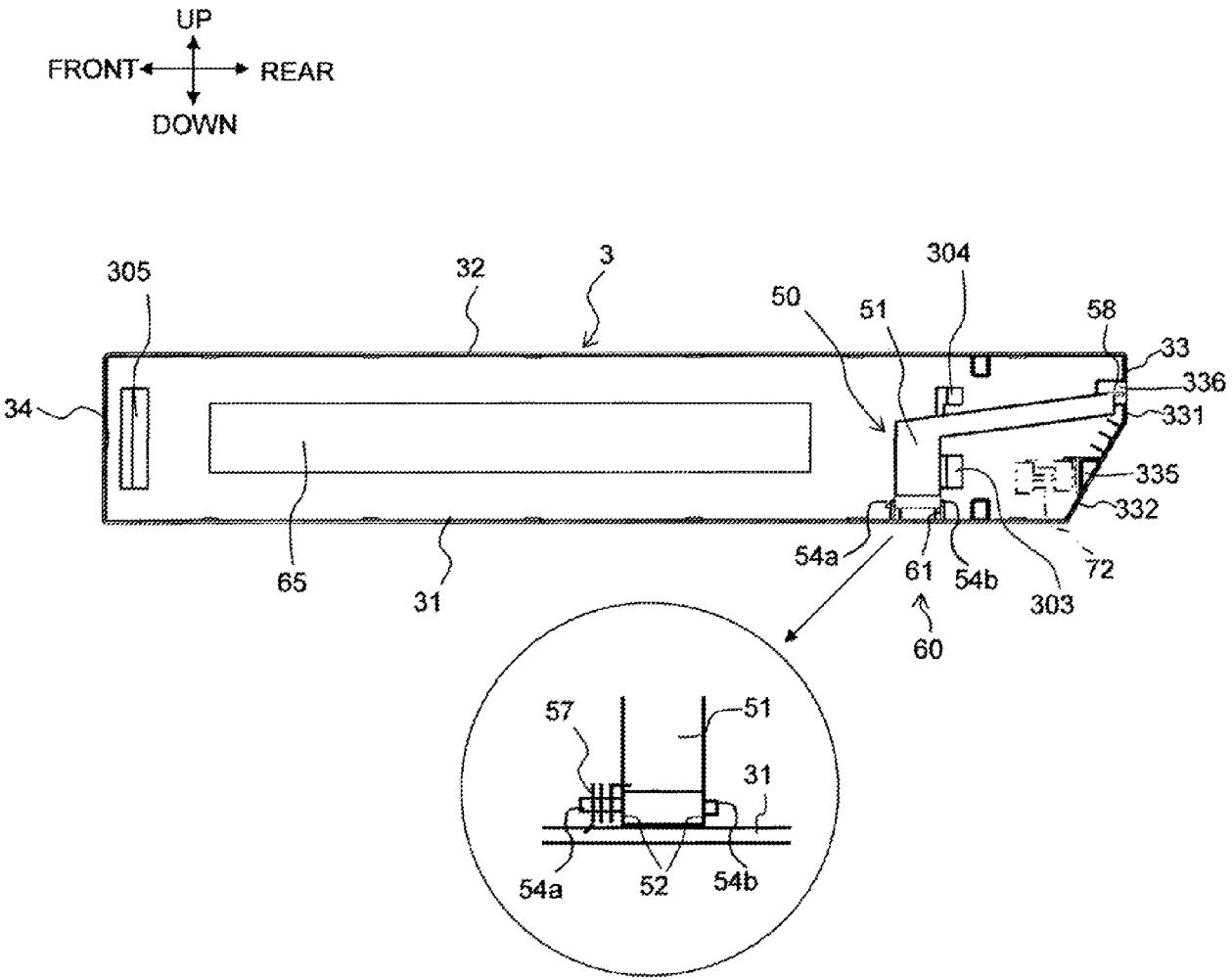
FIG. 14 is a side view showing the housing main body in which the detection plate is installed.

To install the detection plate 50 to the housing main body 3, first the left surface 51*a* of the detection plate 50 is disposed in the housing main body 3 in a state facing the left wall portion 30 of the housing main body 3, as shown in FIGS. 13 and 14. Then, force is applied by hand on at least one of the two arm portions 52 and 52, inward in the direction opposite the protruding direction of the shaft portion 54 (see FIG. 21A described later as well). Then, the area is elastically deformed to the extent that the shaft portion 54 and the above-described concave portion 62 of the mounting plate 61 of the support mechanism 60 do not engage, changing the position of the shaft portion 54 provided to the one arm portion 52. In this state, the external force is removed from the one arm portion 52, bringing the two arm portions 52 near the interval prior to deformation by the elastic force generated by external force removal, engaging the concave portion 61 and the shaft portion 54. As a result, the detection plate 50 is rotatably provided within the housing 2, and the shaft portion 54 is inserted in a position that includes the rotation center of the arm portion 52.

The protruding, that is, front-rear, length of the shaft portions 54*a* and 54*b* provided to the support plates 53 and 53 of the two arm portions 52 and 52 have a relationship such as shown in the above-described FIG. 12, according to this example. That is, the one above-described shaft portion 54*a*, which engages with the concave portion 62 of the front/rear, for example, the front mounting plate 61 of the support mechanism 60, is established longer than the other above-described shaft portion 54*b* which engages with the concave portion 62 of the other front/rear, that is, rear mounting plate 61. Note that the protruding length of the shaft portion 54 may be established in reserve of the above so that the shaft portion 54*a* that enters the concave portion 62 on the front side is shorter, and the shaft portion 54*b* that enters the concave portion 62 on the rear side is longer.

Further, a torsion spring 57 that locks both ends with the abutment plate 51 of the detection plate 50 and the bottom wall portion 31 of the housing main body 3 is installed to the longer shaft portion 54*a* of the two shaft portions 54*a* and 54*b* of the detection plate 50, as shown in the enlarged view in FIG. 14. Then, the shaft portion 54*a* is energized, orientating the abutment plate 51 toward one side of the housing main body 3 in the thickness direction, that is, toward the left wall portion 30. With this arrangement, the detection plate 50 is fixed to the adhesive portion 65 of the left wall portion 30 of the housing main body 3, and one side, that is, the left side, of the abutment plate 51 contacts the reservoir portion 71 of the ink pack 7 housed within the housing 2. As a result, the detection plate 50 rotates in the width direction, that is, the thickness direction, of the housing 2, around the shaft portion 54, in response to the bulging of the reservoir portion 71 associated with the ink volume.

The above-described display portion 58 is inserted through the ink volume detection opening 336 of the upper rear wall portion 331 of the housing main body 3 in the rear portion of the housing 2, with the detection plate 50 provided within the housing 2. The display portion 58 protrudes toward the ink volume detection opening 336 from the other bent side, that is, the end portion opposite the arm portion 52, that is, the upper end, of the detection plate 50. Then, the display portion 58 forms a planar shape that extends in the front-rear direction and width direction, that is, thickness direction, of the housing 2, within the detection opening 336. As a result, the display portion 58 becomes displaced in the substantially horizontal direction and width direction of the housing 2 within the detection opening 336 as the detection plate 50 of the ink pack 7 rotates (see FIG. 4, FIG. 8, etc.).

<Detection of Display Portion>

Figure 15:
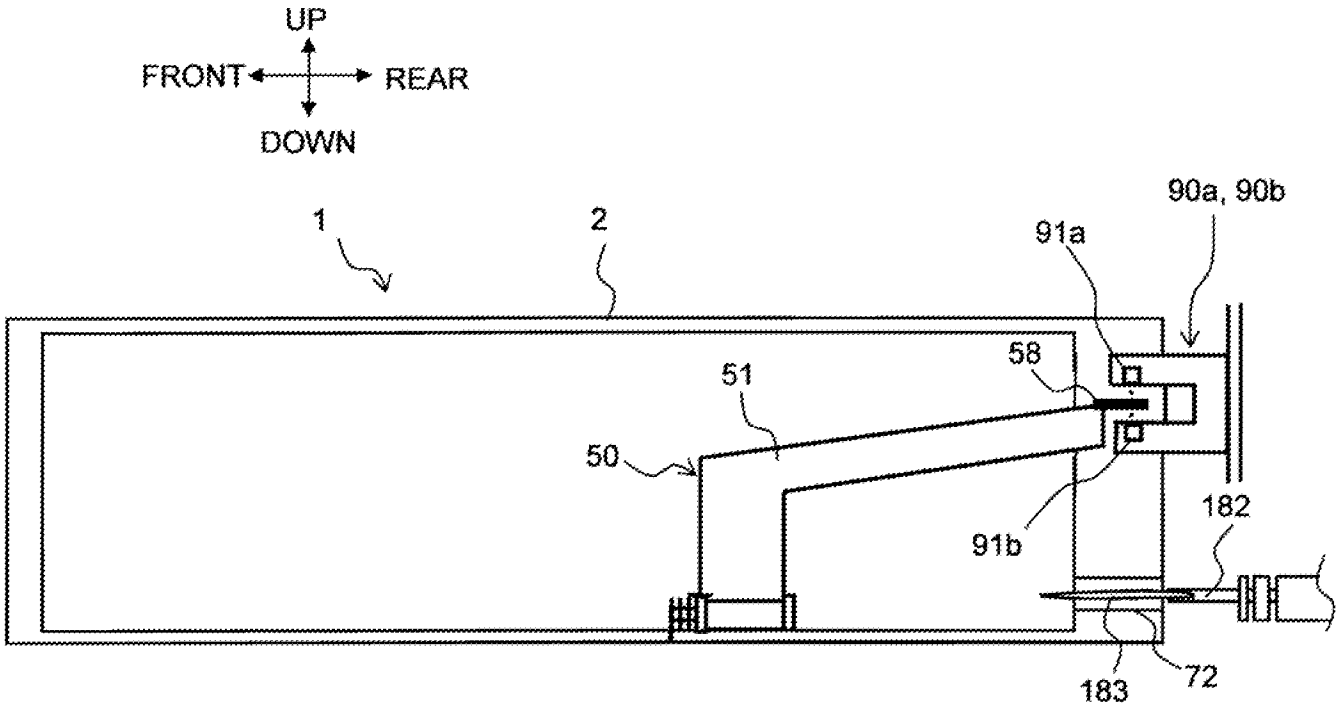
FIG. 15 is an explanatory view showing the installation of the optical sensor of the ink volume detection device to the rear end side of the cartridge mounting portion of the housing of the printer.

At this time, the displacement of the above-described display portion 58 in the substantially horizontal direction is detected on the printer 100 side. Detection of this displacement will now be described using FIG. 15 and FIG. 16. As shown in FIG. 15, a first sensor 90*a* and a second sensor 90*b* of an optical form are provided as ink volume detection devices to a vertical position corresponding to the display portion 58 of the detection plate 50, on the rear end side of the cartridge mounting portion 108 of the housing 101 of the printer 100. The first sensor 90*a* and the second sensor 90*b* are provided in parallel in the width direction of the housing 2. The first sensor 90*a* and the second sensor 90*b* are light-transmitting sensors comprising a light emitter 91*a* and a light receptor 91*b* at upper and lower locations with the display portion 58 therebetween. As shown by the white arrow, the display portion 58 is displaced in the width direction, that is, the horizontal direction, of the housing 2, blocking the light emitted from the light emitter 91*a* toward the light receptor 91*b*. Then, the first sensor 90*a* and the second sensor 90*b* each change from an ON state in which the light receptor 91*b* receives light to an OFF state. A detection signal corresponding to this ON state or OFF state of the first sensor 90*a* and the second sensor 90*b* is inputted to a CPU (not shown) of the printer 100. The CPU is capable of determining the ink volume within the reservoir portion 71 of the ink pack 7 based on four levels, in accordance with the detection signal from the first sensor 90*a* and the second sensor 90*b*.

That is, when there is a high volume of ink within the reservoir portion 71, the reservoir portion 71 has sufficient thickness in the width direction, that is, the horizontal direction, and the display portion 58 of the detection plate 50 is positioned near the left side. In this case, as shown in FIG. 16A which simplifies the relationship between the display portion 58, the first sensor 90*a*, and the second sensor 90*b* as viewed from above, only the first sensor 90*a* of the first sensor 90*a* and the second sensor 90*b* which is positioned on the left side turns OFF. As a result, as shown in FIG. 16E, the ink volume of the reservoir portion 71 is determined as full.

From the above-described state, the display portion 58 of the detection plate 50 moves slightly near the right side as the ink volume within the reservoir portion 71 slightly decreases. In this case, as shown in FIG. 16B, both the first sensor 90*a* and the second sensor 90*b* turn OFF. As a result, as shown in FIG. 16E, the ink volume of the reservoir portion 71 is determined as not full but still sufficient.

Subsequently, the display portion 58 of the detection plate 50 further moves further near the right side as the ink volume within the reservoir portion 71 further decreases. In this case, as shown in FIG. 16C, the first sensor 90*a* turns ON and the second sensor 90*b* turns OFF. As a result, as shown in FIG. 16E, the ink volume of the reservoir portion 71 is determined as close to empty.

Subsequently, the display portion 58 of the detection plate 50 moves further near the right side as the ink volume within the reservoir portion 71 further decreases, coming close to empty. In this case, as shown in FIG. 16D, both the first sensor 90*a* and the second sensor 90*b* turn ON. As a result, as shown in FIG. 16E, the ink volume of the reservoir portion 71 is determined as empty.

The above-described CPU of the printer 100 issues notifications and prohibits printing in accordance with the ink volume, based on the above-described determination results.

<Collapse Prevention Rib>

Next, the above-described collapse prevention rib 80, which is one more special characteristic of this embodiment, will be described using FIGS. 17 to 19.

Figure 17:
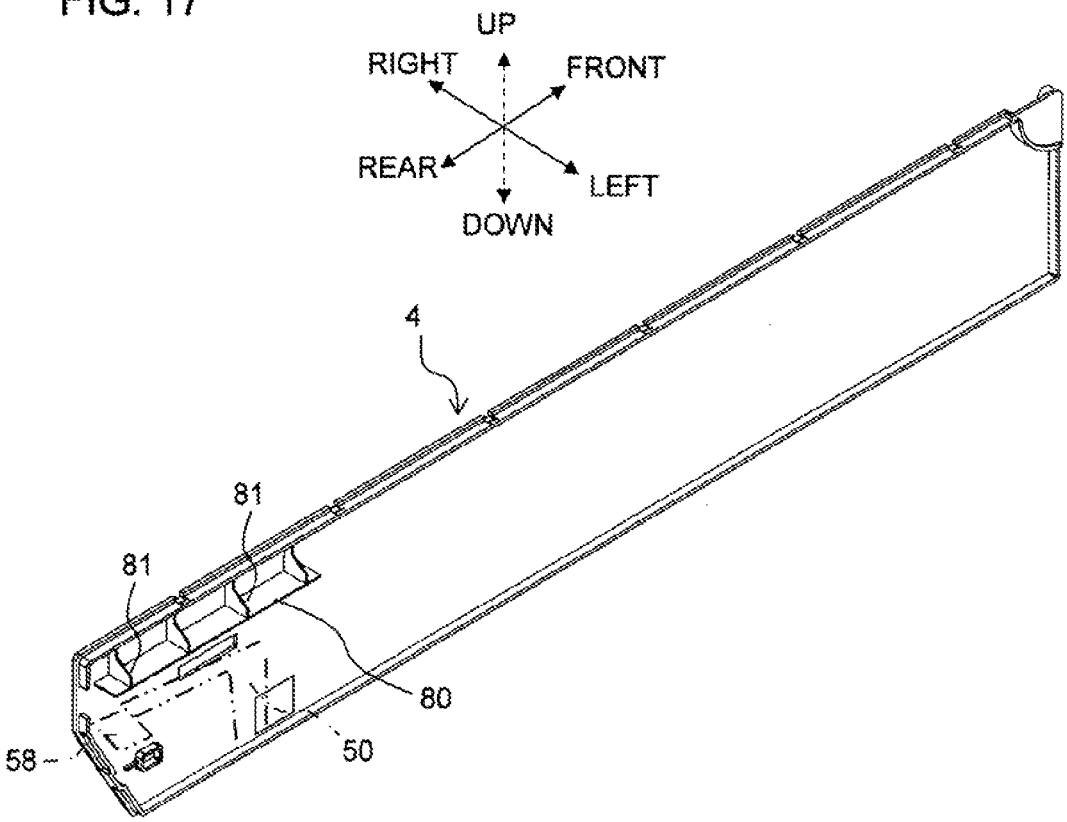
FIG. 17 is a perspective view of the cover of the housing of the ink cartridge, as viewed from the rear.
Figure 18:
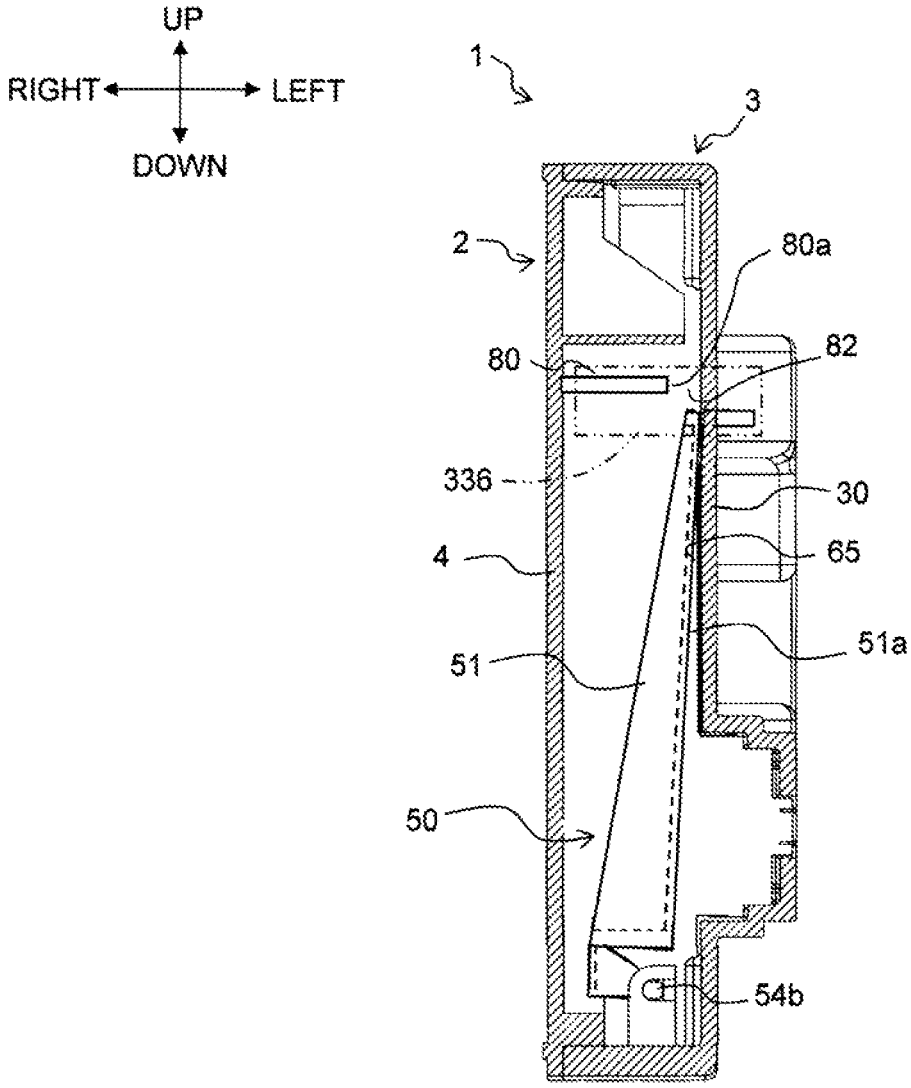
FIG. 18 is a cross-sectional view showing the cross-sectional structure of the cross-section XVIII-XVIII' of FIG. 8, with the ink pack removed.

As shown in FIGS. 17 to 19, the above-described collapse prevention rib 80 which prevents the collapse of the reservoir portion 71 of the ink pack 7, and the above-described reinforcement rib 81 which reinforces the collapse prevention rib 80 are provided to the upper inner surface of the cover 4, on the rear portion. The collapse prevention rib 80 is established on the upper inner surface of the cover 4, on the rear portion. Further, the collapse prevention rib 80 creates a predetermined gap 82 between a left end portion 80*a* and the left lateral surface of the housing 2, that is, with the left wall portion 30 of the housing main body 3, and extends substantially horizontally above the detection plate 50. This collapse prevention rib 80 is positioned further rearward than the rear end portion of the adhesive portion 65 previously described (see FIG. 3 and FIG. 10 as well). Further, the vertical position of the collapse prevention rib 80 is further upward than the vertical position of the upper end portion of the adhesive portion 65 of the left wall portion 30 (see FIG. 18). The reinforcement rib 81 extends substantially vertically so that it intersects with the collapse prevention rib 80 in at least one location, in four locations in this example, in the substantially horizontal direction of the collapse prevention rib 80 that extends substantially horizontally. The reinforcement rib 81 connects the collapse prevention rib 80 and the right lateral surface of the housing 2, that is, the cover 4.

Figures 19A, 19B, 19C:
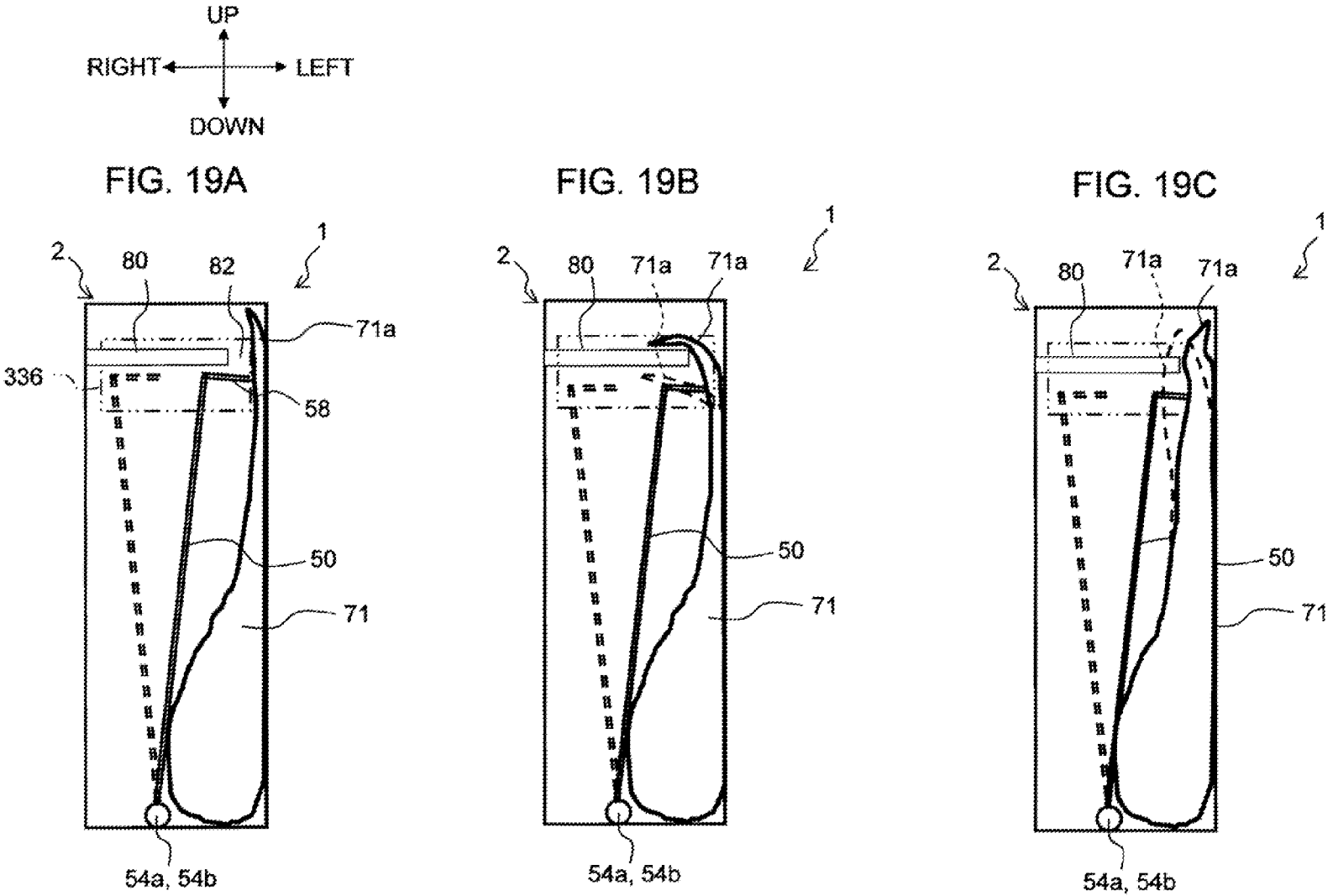
FIG. 19A is an explanatory view showing the action of the collapse prevention rib provided to the housing.
FIG. 19B is an explanatory view showing the action of the collapse prevention rib provided to the housing.
FIG. 19C is an explanatory view showing the action of the collapse prevention rib provided to the housing.

The reservoir portion 71 of the ink pack 7 contacts and is fixed by the adhesive portion 65 of the left wall portion 30. As shown in FIG. 19A, an upper portion 71*a* of the reservoir portion 71 is inserted through the gap 82. When the ink volume decreases in the interior as a result of ink usage, decreasing the ink level, the interior of the upper portion 71*a* of the reservoir portion 71 becomes empty, as shown in the above-described FIG. 19A. In this case, the upper portion 71*a* that has become empty may collapse or hang downward toward the right due to the elasticity of the bag of the reservoir portion 71, changing from the dashed-line state to the solid line state in FIG. 19B. In such a case, the collapsed upper portion 71*a* may contact the detection plate 50, causing the display of the ink volume by the rotational position associated with the ink volume of the detection plate 50 to become inaccurate.

According to this embodiment, the collapse prevention rib 80 is provided in response to the above. Further, the upper portion 71*a* of the reservoir portion 71 is inserted through the gap 82 formed between the collapse prevention rib 80 and the left lateral surface of the housing 2, that is, with the left wall portion 30 of the housing main body 3. With this arrangement, even if the upper portion 71*a* of the reservoir portion 71 attempts to collapse downward toward the right, the collapse prevention rib 80 receives and stops the upper portion 71*a* as shown in FIG. 19B, suppressing further displacement of the reservoir portion 71 to the right. Further, as shown in FIG. 19C, the collapse prevention rib 80 also suppresses the upper area of the reservoir portion 71 from bulging, deforming, and contacting the detection plate 50.

Figure 20A:
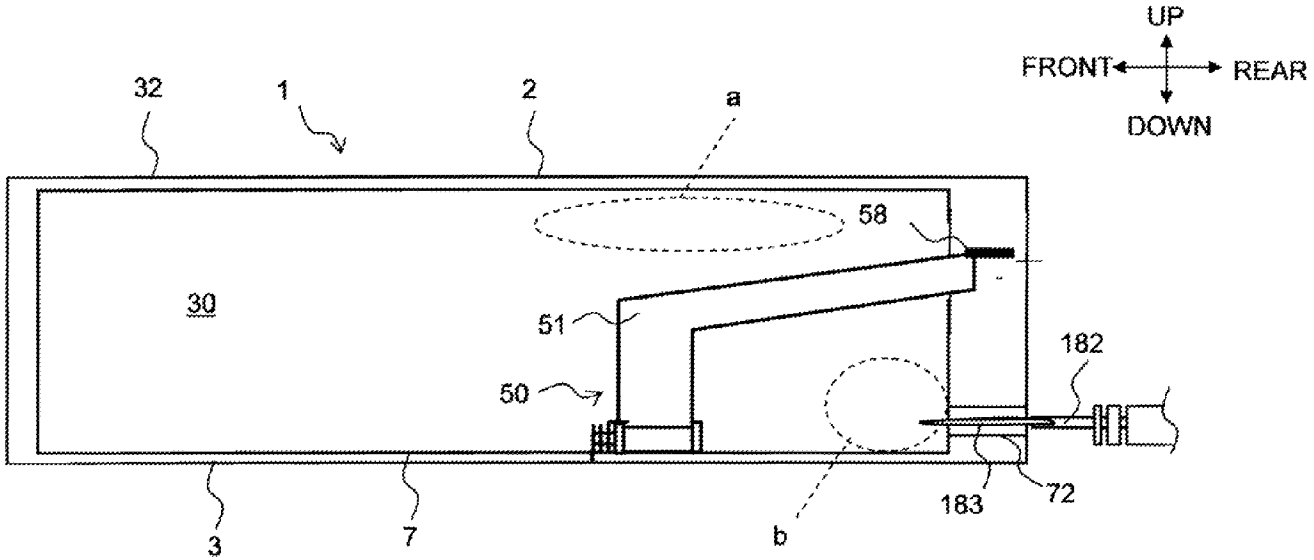
FIG. 20A is an explanatory view showing an inappropriate location for installation of the detection plate within the housing.
Figure 20B:
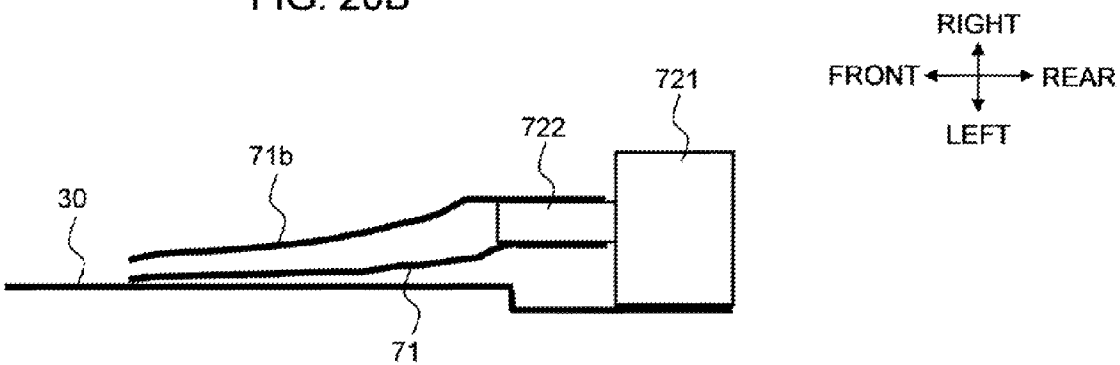
FIG. 20B is an explanatory view showing an inappropriate location for installation of the detection plate within the housing.

Note that, at this time, as shown in FIG. 20A which is a side view of the interior of the housing 2, the ink volume of the reservoir portion 71 cannot be properly detected in a case where the detection plate 50 is provided so that the abutment plate 51 contacts the reservoir portion 71 at an upper location A near the rear, that is, at a location near the upper wall portion 32 near the rear portion of the housing main body 3. Further, also in a case where the abutment plate 51 is made to contact the reservoir portion 71 at a location B near the plug 72 of the ink pack 7 of FIG. 20A, similarly the residual ink volume cannot be accurately detected. This is due to the structure of the joining portion 722 that is heat-sealed to the sheets of the reservoir portion 71 and the above-described main body portion 721 that fixes the plug 72 to the housing 2, and the positional relationship with the reservoir portion 71, as shown in FIG. 20B, which is a view of the housing 2 from the lower side. That is, as a result of the above-described structure and above-described positional relationship, a right lateral surface 71*b* of the reservoir portion 71 has a certain positional relationship, regardless of the residual ink volume within the reservoir portion 71. Consequently, the detection plate 50 is preferably provided in a form that avoids contact of the abutment plate 51 with reservoir portion 71 at the above-described locations A and B.

As described above, according to this embodiment, the support mechanism 60 of the detection plate 50 comprises the two concave portions 62 and 62 for rotatably supporting the detection plate 50 provided to the housing 2. The concave portions 62 and 62 are provided at a predetermined interval in the axial direction X of the plug 72 of the reservoir portion 71, that is, in the front-rear direction of the housing 2. On the other hand, the detection plate 50 comprises the two arm portions 52 and 52 and the shaft portions 54*a* and 54*b*. The two arm portions 52 and 52 are at least partially elastic and are provided at a predetermined interval. The shaft portions 54*a* and 54*b* are respectively provided to protrude outward from the two arm portions 52 and 52 and are linearly disposed at an interval, comprising a shape capable of engaging with the concave portions 62 of the support mechanism 60. At this time, the detection plate 50 is capable of elastic deformation wherein at least one arm portion 52 receives an external force in an inward direction that is opposite the protruding direction of the shaft portions 54*a* and 54*b*, changing the position of the shaft portion 54 provided to the one of the arm portions 52 to the extent that the concave portion 62 and the shaft portion 54 do not engage. Further, when the above-described external force is removed from the one of the arm portions 52, generating an elastic force near the above-described predetermined interval and causing the concave portion 62 and the shaft portion 54 to engage, the shaft portions 54*a* and 54*b* are located in positions that include the rotation center of the arm portions 52. With this arrangement, the detection plate 50 rotates around the rotation center of the above-described arm portion 52 on the axis in the same direction as the axial direction X of the plug 72 of the reservoir portion 71, in accordance with the ink volume within the reservoir portion 71. As a result, the change in the ink volume can be detected by the rotation of the detection plate 50.

During the assembly of the ink cartridge, the above-described detection plate 50 is mounted to the support mechanism 60 fixed to the housing 2. The two arm portions 52 and 52 of the detection plate 50 are partially elastic, as described above. With this arrangement, the worker can shorten the distance between the two arm portions 52 by utilizing external force. That is, during the above-described mounting, the worker applies external force by hand to at least one of the two arm portions 52 and 52, in the inward direction that is opposite the protruding direction of the shaft portions 54*a* and 54*b* provided to the one arm portion 52 and 52. Then, the worker elastically deforms the one of the arm portions 52 to the extent that the shaft portion 54*a* or 54*b* of the one of the arm portions 52 does not engage with one concave portion 62 of the support mechanism 60. Then, in this state, the shaft portion 54*b* or 54*a* of the other arm portion 52 engages with the other concave portion 62 of the support mechanism 60. Subsequently, the worker positions the shaft portion 54*a* or 54*b* of the one of the arm portions 52 to the other concave portion 62 of the support mechanism 60, and releases his or her hand to remove the external force applied to the one of the arm portions 52. As a result, the one of the arm portions 52 returns to its original shape by the elastic force generated in one arm portion 52. Consequently, the above-described two shaft portions 54*a* and 54*b* are respectively engaged with the above-described concave portions 62 and 62, and rotatably supported around the axis in the same direction as the axial direction X of the plug 72 of the above-described reservoir portion 71.

By thus utilizing the shortening operation of the two arm portions 52 and 52 of the detection plate 50, it is possible to easily mount the detection plate 50 onto the support mechanism 60. As a result, the assemble-ability of the detection plate 50 is improved, making it possible to improve the productivity of the ink cartridge 1.

Further, in particular, according to this embodiment, the detection plate 50 comprises the abutment plate 51 that comes in contact with the reservoir portion 71 on the left side. With the reservoir portion 71 coming in contact with a surface 51*a* of the above-described one side of the abutment plate 51, the reservoir portion 71 bulges to the extent of the high volume of ink within the reservoir portion 71, pressing the abutment plate 51 to the other side. With the rotation of the detection plate 50 by this applied pressure, rotation of the detection plate 50 in accordance with the ink volume is achieved.

Figure 23B:
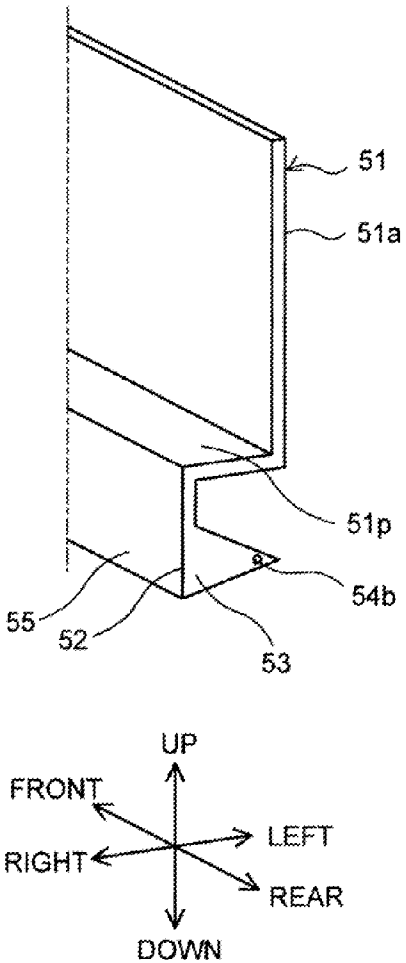
FIG. 23B is a conceptual explanatory view showing a modification example related to the jutting structure of the right end portion of the arm portion.
Figure 23A:
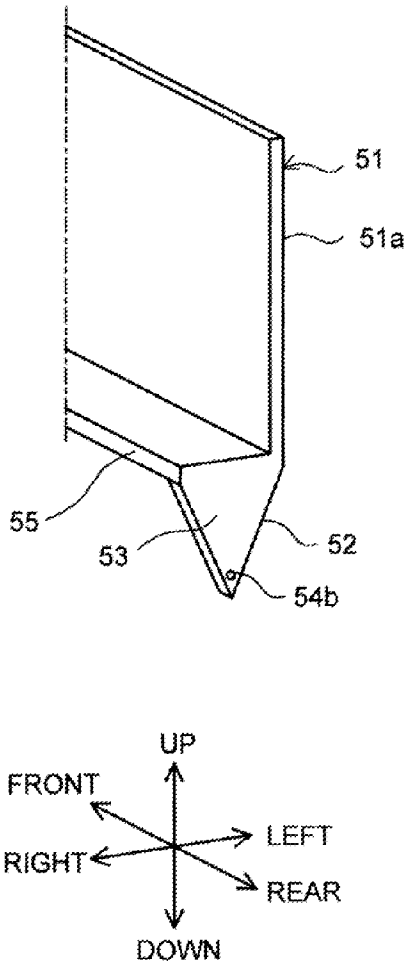
FIG. 23A is a conceptual explanatory view showing a modification example related to the jutting structure of the right end portion of the arm portion.

Further, the right end portion of the arm portion 52 is designed to jut out further over the right side than the right end portion of the abutment plate 51. This design has significance such as follows. That is, from the viewpoint of maintaining strength during the above-described elastic deformation, one approach is to design a structure in which at least a part of the arm portion 52 juts out further than the abutment plate 51. Given a structure in which the a part of the arm portion 52 juts out on the left side further than the abutment plate 51, the reservoir portion 71 which bulges in accordance with the ink volume as described above may come in contact with the above-described jutting arm portion 52 and not with or along with the abutment plate 51. To avoid this harmful effect, according to this embodiment, the right end portion of the arm portion 52 is designed to jut out on the right side further than the right end portion of the abutment plate 51. Such a structure in which the arm portion 52 thus juts out to the right prevents the end portion on the left side of the arm portion 52 from jutting out on the left side further than the abutment plate 51, making it possible to prevent such a harmful effect. As a result, it is possible to achieve rotation of the detection plate 50 favorably following the change in the ink volume. For example, according to the example shown in FIG. 23A, the connecting plate 55 extends horizontally from the abutment plate 51 so that it is further rightward than the abutment plate 51, and the arm portion 52 is provided thereunder. Even in this case, because the arm portion 52 is provided further rightward than the abutment plate 51, the above advantage is achieved. Further, according to the example shown in FIG. 23B, the connecting plate 55 is provided to the lower end of the abutment plate 51, via a horizontally extended horizontal plate 51*p*. In this case as well, because the connecting plate 55 is provided further rightward than the abutment plate 51 and the arm portion 52 is provided further rightward than the abutment plate 51, the above-described advantage is achieved.

Further, in particular, according to this embodiment, the arm portion 52 comprises the substantially triangular-shaped or substantially trapezoidal-shaped support plate 53 that extends from the left end area toward the right area where the above-described shaft portions 54*a* and 54*b* are provided. With this arrangement, the end area of the above-described left side of the support plate 53, which is a side having a narrow width, is readily elastically deformed, making it possible to easily shorten the distance between the above-described two shaft portions 54.

Further, in particular, according to this embodiment, the detection plate 50 comprises the connecting plate 55 configured to connect the support plates 53 of the two arm portions 52 in the area on the right side. With this arrangement, it is possible to firmly support the support plates 53 that elastically deform the end area via the connecting plate 55.

Further, in particular, according to this embodiment, the protruding length of the shaft portions 54 of the two arm portions 52 of the detection plate 50 are designed so that the length of the one shaft portion 54*a* is longer than that of the other shaft portion 54*b*. When the worker inserts the shaft portions 54*a* and 54*b* of the two arm portions 52 of the detection plate 50 into the two concave portions 62 of the support mechanism 60, the worker first inserts the longer shaft portion 54*a* of the one arm portion 52 into one of the concave portions 62. Subsequently, the worker flexibly deforms the other arm portion 52, making it possible to insert the shorter shaft portion 54*b* into the other concave portion 62 of the support mechanism 60. As a result, the worker can reliably elastically deform the detection plate 50 with minimal deformation and easily mount the detection plate 50 onto the support mechanism 60.

Further, in particular, according to this embodiment, the support mechanism 60 comprises the two mounting plates 61 that are orthogonal to the axial direction of the plug 72 of the reservoir portion 71 and provided at a predetermined interval in the axial direction of the plug 72. Then, the above described concave portion 62 is formed as a through-hole through which the mounting plate 61 is inserted, or as a blind hole that opens in the direction opposite the protruding direction of the shaft portion 54 of the arm portion 52 of the detection plate 50, in the axial direction X of the plug 72 of the reservoir portion 71. With this arrangement, the housing 2 comprising the support mechanism 60 can be formed without using a slide in the die, making it possible to manufacture the housing 2 that offers easy installation of the detection plate 50 and the support mechanism 60 with ease.

Further, in particular, according to this embodiment, the display portion 58 of the detection plate 50 is made of a flat plate that protrudes from the end portion of the side opposite the above-described arm portion 52 toward the above-described opening of the ink volume detection opening 336 on the rear portion of the housing 2. This flat plate extends in the axial direction of the plug 72 of the reservoir portion 71 and in the direction from the abutment plate 51 of the detection plate 50 toward the reservoir portion 71, within the opening 336.

With this arrangement, the ink volume can be displayed in a manner that is instinctively easy-to-understand by the operator.

Figure 21A:
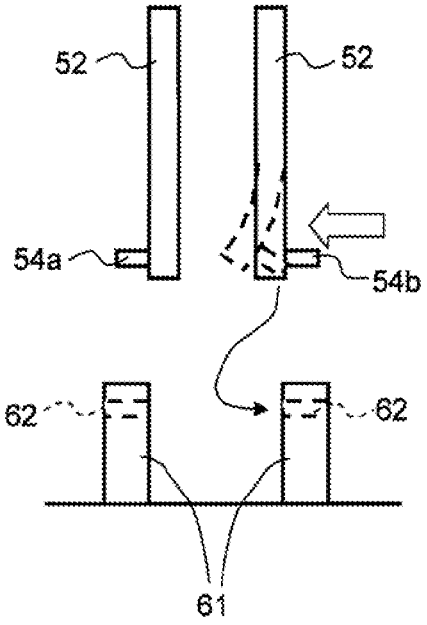
FIG. 21A is an explanatory view explaining the installation method of the shaft portion when the shaft portion of the detection plate is installed in the concave portion of the support device.
Figure 21B:
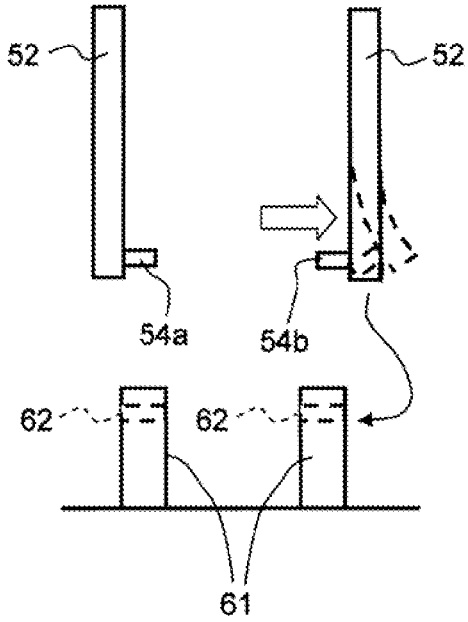
FIG. 21B is an explanatory view explaining the installation method of the shaft portion in a modification example in which the shaft portion of the detection plate is made to protrude inward.

Note that while, according to this embodiment, the shaft portions 54*a* and 54*b* of the arm portions 52 of the detection plate 50 are made to protrude outward in a direction that intersects with the extending direction of the arm portions 52, as schematically shown in FIG. 21A, the present invention is not limited thereto. That is, as shown in FIG. 21B, the shaft portions 54*a* and 54*b* may be made to protrude inward in a direction that intersects the extending direction of the arm portions 52. In this case, an external force may be applied to at least one of the arm portions 52 in the outward direction opposite the protruding direction of the shaft portions 54*a* and 54*b* for engagement with the concave portion 62 of the mounting plate 61 of the support mechanism 60.

Figure 22:
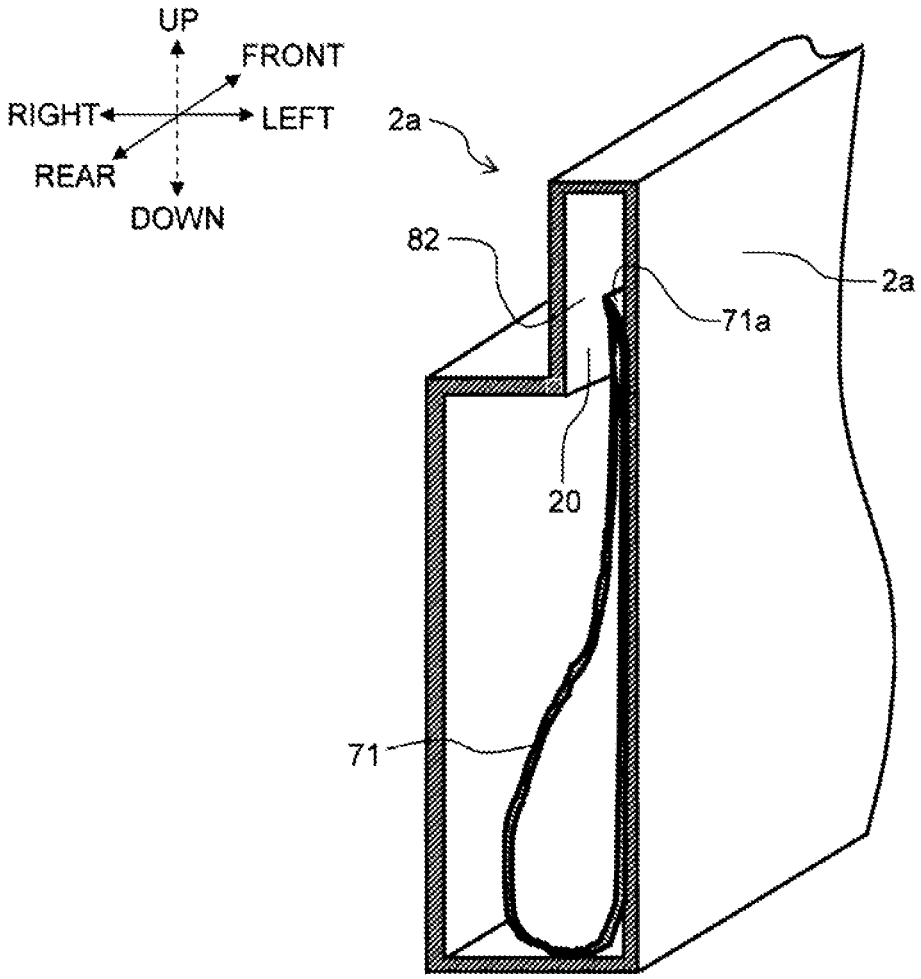
FIG. 22 is a perspective view showing a cutaway of the housing in a modification example in which a lateral surface having a cutout portion cut out into an L-shape serves as the displacement suppressing portion.

Further, while the collapse prevention rib 80 is provided as a displacement suppressing portion of the ink pack 7 within the housing 2 according to this embodiment, the present invention is not limited thereto. That is, as shown in FIG. 22, the housing 2A may be formed with at least the upper portion on the rear side of the substantially rectangular parallelepiped shape comprising a longwise direction, shortwise direction, and thickness direction cut out into an L-shape. In such a case, at least a section of the housing 2A located in the area where the detection plate 50 is disposed, that is, a lateral surface 20 in the same direction as the above-described shortwise direction where the above-described predetermined gap 82 is created with a lateral surface 2*a* on the left side of the housing 2A, can be established as the displacement suppressing portion of the ink pack 7.

Additionally, other than those previously described, methods according to the above-described embodiments and modification examples may be utilized in combination as appropriate.

Note that various modifications which are not described in particular can be made according to the present invention without departing from the spirit and scope of the invention.

What is claimed is:

1. An ink cartridge for storing ink, comprising:

a reservoir portion configured to store ink;

a housing configured to cover said reservoir portion;

a moving member capable of executing, a display in accordance with an ink volume within said reservoir portion based on a rotational position achieved by contacting said reservoir portion and rotating in accordance with a change in a contact position with said reservoir portion; and a support device provided to said housing and comprising at a predetermined interval in a first direction as an axial direction of a plug of said reservoir portion two concave portions for rotatably supporting said moving member; wherein:

said moving member has:

two arm portions at least partially elastic, provided at a predetermined interval in said first direction and that extends along a second direction orthogonal to said first direction; and a convex portion of a shape engageable with said concave portion, provided protruding from each of two of said arm portions along said first direction, disposed linearly at an interval in said first direction; and at least one of said arm portions is capable of elastic deformation in which, upon receipt of an external force along said first direction toward a direction opposite a protruding direction of said convex portion, changes a position of the convex portion provided to said one of said arm portions to an extent that said concave portion and said convex portion do not engage, generates an elastic force near said predetermined interval along said first direction when said external force is removed from said one of said arm portions, and positions said convex portion in a position, that includes a rotation center of said arm portion when said concave portion and said convex, portion engage.

2. The ink cartridge according to claim 1, wherein:

said moving member has an abutment plate with which said reservoir portion comes in contact on one side of the abutment plate; and an end portion of the other side of said arm portion is configured to jut out further toward that other side than an end portion of the other side of said abutment plate.

3. The ink cartridge according to claim 1, wherein:

said convex portions of two said arm portions of said moving member are each provided protruding toward the outside alone said first direction; and at least one of said arm portions is capable of elastic deformation in which, upon receipt of the external force along said first direction toward the direction opposite the protruding direction of said convex portion, decreases an interval at which a convex portion and another convex portion are provided to said one of said arm portions to an extent that said concave portion and said convex portion do not engage, generates an elastic force near said predetermined interval along said first direction when said external force is removed from said one of said arm portions, and positions said convex portion in a position that includes a rotation center of said arm portion when said concave portion and said convex portion engage.

4. The ink cartridge according to claim 1, wherein;

said convex portions of two said arm portions of said moving member are each provided protruding toward the inside along said first direction; and at least one of said arm portions is capable of elastic deformation in which, upon receipt of the external force along said first direction toward the direction opposite the protruding direction of said convex portion, decreases an interval at which a convex portion and another convex portion are provided to said one of said arm portions to an extent that said concave portion and said convex portion do not engage, generates an elastic force near said predetermined interval along said first direction when said external force is removed from said one of said arm portions, and positions said convex portion in a position that includes a rotation center of said arm portion when said concave portion and said convex portion engage.

5. The ink cartridge according to claim 1, wherein:

said moving member has a connecting plate configured to connect said support plates of two said arm portions.

6. The ink cartridge according to claim 1, wherein:

said arm portion has a substantially triangular-shaped or substantially trapezoidal-shaped support plate configured to extend from an end area on one side to an area on another side to which said convex portion is provided.

7. The ink cartridge according to claim 1, wherein:

a protruding length of said convex portion of two arm portions of said moving member is longer for one convex portion than the other convex portion.

8. The ink cartridge according, to claim 1, wherein:

said support device has two mounting plates that are orthogonal to an axial direction of said plug of said reservoir portion, and are positioned at a predetermined interval along the axial direction of said plug; and said concave portion is a through-hole configured to pass through said mounting plate, or a blind hole that opens in a direction opposite a protruding direction of said convex portion of said arm portion of said moving member, along an axial direction of said plug of said reservoir portion.

9. The ink cartridge according to claim 1. wherein:

said housing has an opening on a lateral surface of one side of said reservoir portion in a third direction orthogonal to said first direction as well as to said second direction;

said moving member has a display portion that is displaced in a rotation direction in accordance with an ink volume within said reservoir portion by a rotation of said moving member, at an end portion of an edge frame extending along said first direction on a side opposite said arm portion of said moving member; and said display portion is a flat plate that protrudes toward said opening from the end portion on the side opposite said arm portion of said moving member, and extends along said first direction as well as said second direction, within said opening.

10. The ink, cartridge according to claim 9, wherein:

said display portion faces to an area near said opening.

11. The ink cartridge according to claim 9, wherein:

said display portion is displaced along said second direction within said opening in accordance with the rotation of said moving member.

* * * * *